US008764008B2

(12) United States Patent
Otsuki et al.

(10) Patent No.: US 8,764,008 B2
(45) Date of Patent: Jul. 1, 2014

(54) MEDIUM TRANSPORTING DEVICE AND IMAGE FORMING DEVICE

(75) Inventors: Naohito Otsuki, Kanagawa (JP); Michio Tada, Kanagawa (JP); Takashi Abe, Kanagawa (JP); Yousuke Hasegawa, Kanagawa (JP); Shouichi Maeda, Kanagawa (JP); Youichi Yamakawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1136 days.

(21) Appl. No.: 12/728,402

(22) Filed: Mar. 22, 2010

(65) Prior Publication Data

US 2010/0296854 A1 Nov. 25, 2010

(30) Foreign Application Priority Data

May 20, 2009 (JP) ..... 2009-121962

(51) Int. Cl.
*B65H 9/16* (2006.01)

(52) U.S. Cl.
USPC ..... 271/251; 271/248; 271/227; 271/249; 399/394; 399/395

(58) Field of Classification Search
USPC ..... 271/251, 248, 249, 250, 227, 228; 399/394, 395
See application file for complete search history.

(56) References Cited

U.S. PATENT DOCUMENTS

| | | | | |
|---|---|---|---|---|
| 7,641,191 | B2 * | 1/2010 | Inui | 271/251 |
| 2006/0099019 | A1 * | 5/2006 | Howe | 399/395 |
| 2007/0065200 | A1 * | 3/2007 | Asaba | 399/394 |
| 2010/0047000 | A1 * | 2/2010 | Park et al. | 399/394 |

FOREIGN PATENT DOCUMENTS

| | | | |
|---|---|---|---|
| JP | 63-185758 | A | 8/1988 |
| JP | 2000-229737 | A | 8/2000 |
| JP | 2001-323966 | A | 11/2001 |
| JP | 2005-112543 | A | 4/2005 |
| JP | 2005-241669 | A | 9/2005 |

* cited by examiner

*Primary Examiner* — Luis A Gonzalez
(74) *Attorney, Agent, or Firm* — Sughrue Mion, PLLC

(57) ABSTRACT

A medium transporting device includes: a transporting path; a contacted member that is provided on the transporting path to be movable in a medium width direction orthogonal to a medium transporting direction; a line-up member on the transporting path that lines up a position of the medium by sending the medium transported on the transporting path to the contacted member to bring the end of the medium in the medium width direction into contact with the contacted member; a displacement amount calculation unit that sets on a downstream side of the line-up member in the medium transporting direction, and calculates a misregistration amount of the medium in the medium width direction; and a contacted position control unit that controls a position of the contacted member by moving the contacted member in a direction of reducing the misregistration amount.

8 Claims, 22 Drawing Sheets

(FIG. 7 Continued)
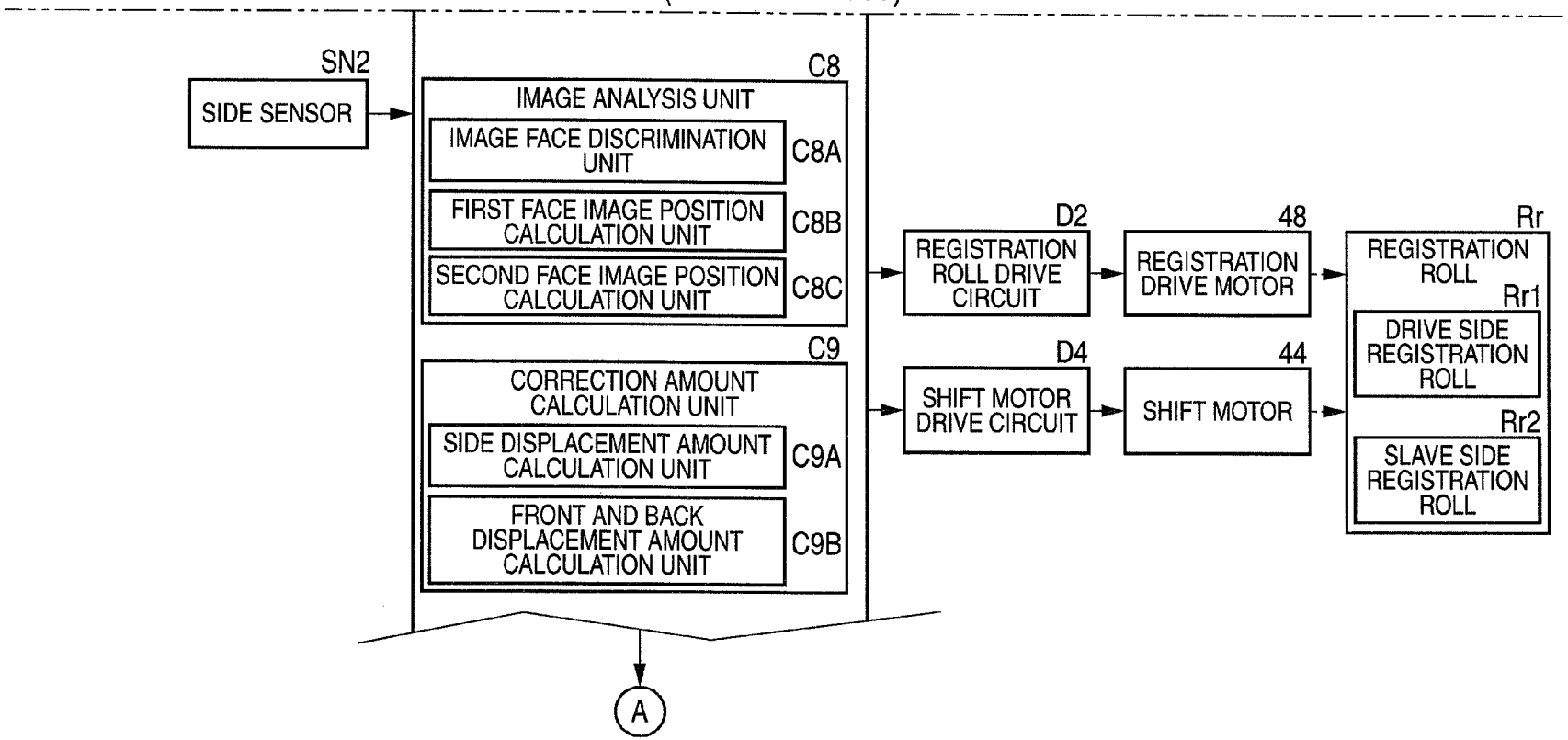

(FIG. 8 Continued)
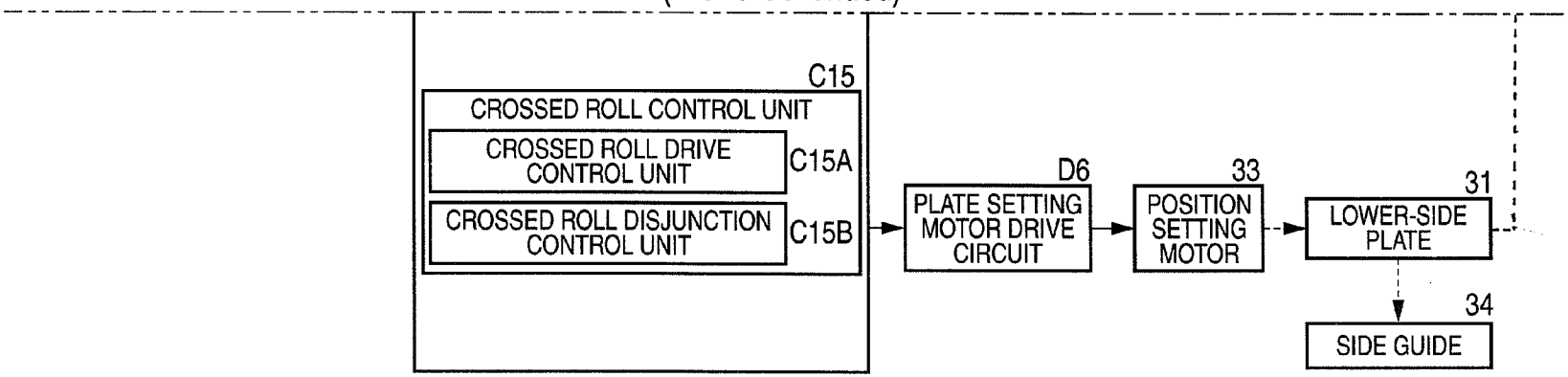

INITIAL SETTING PROCESS (FIG.12 Continued)
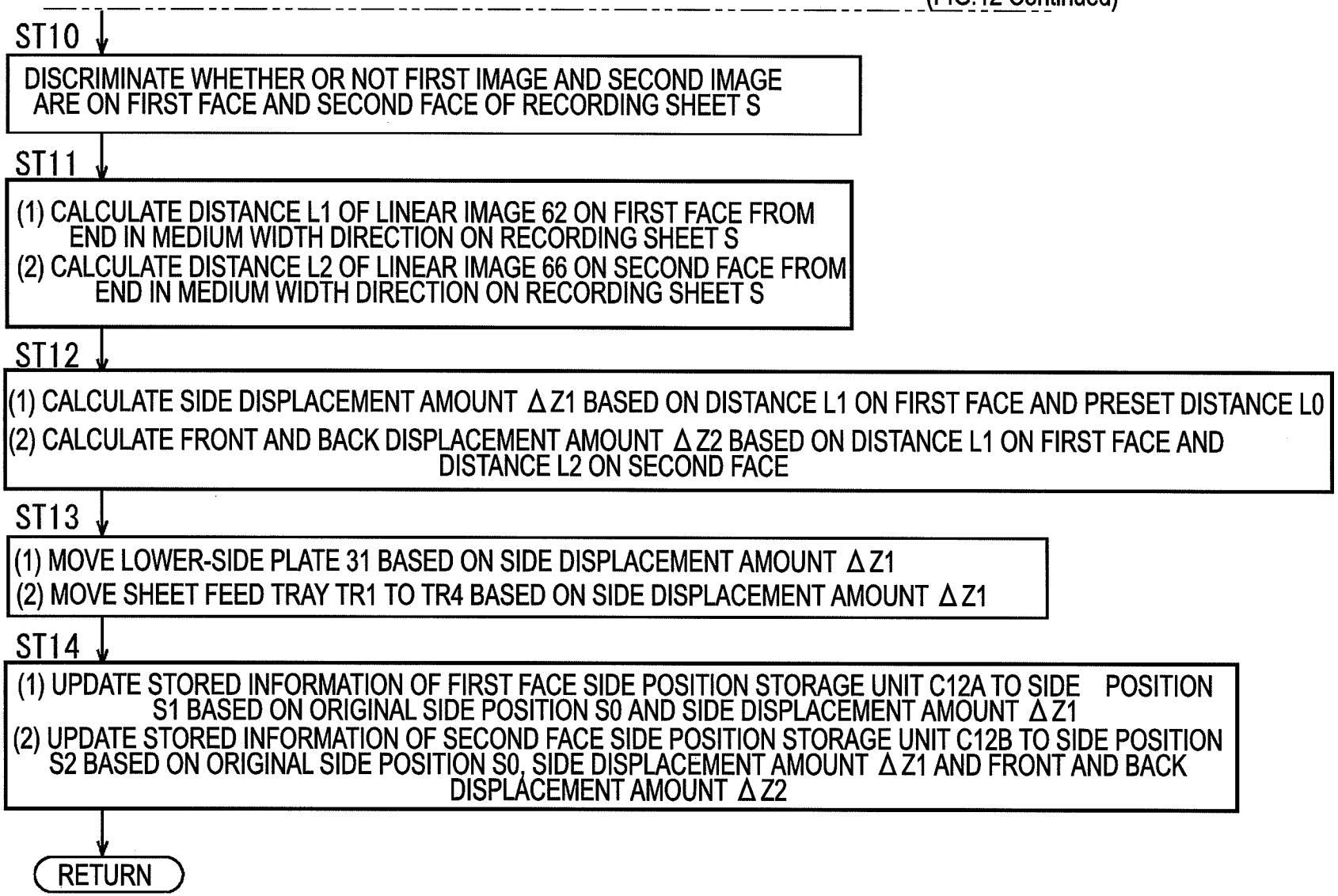

(FIG.14 Continued)
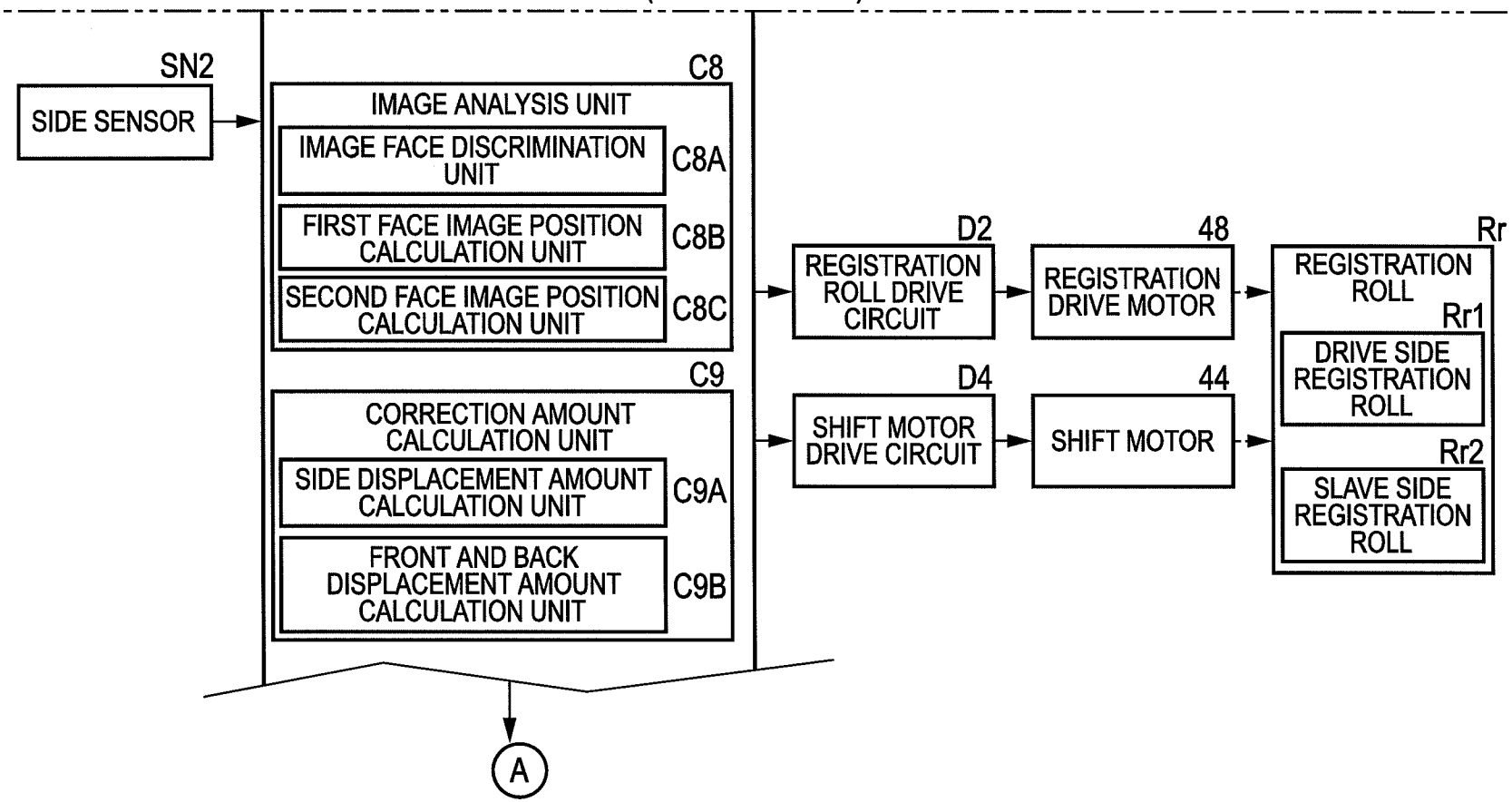

(FIG.15 Continued)
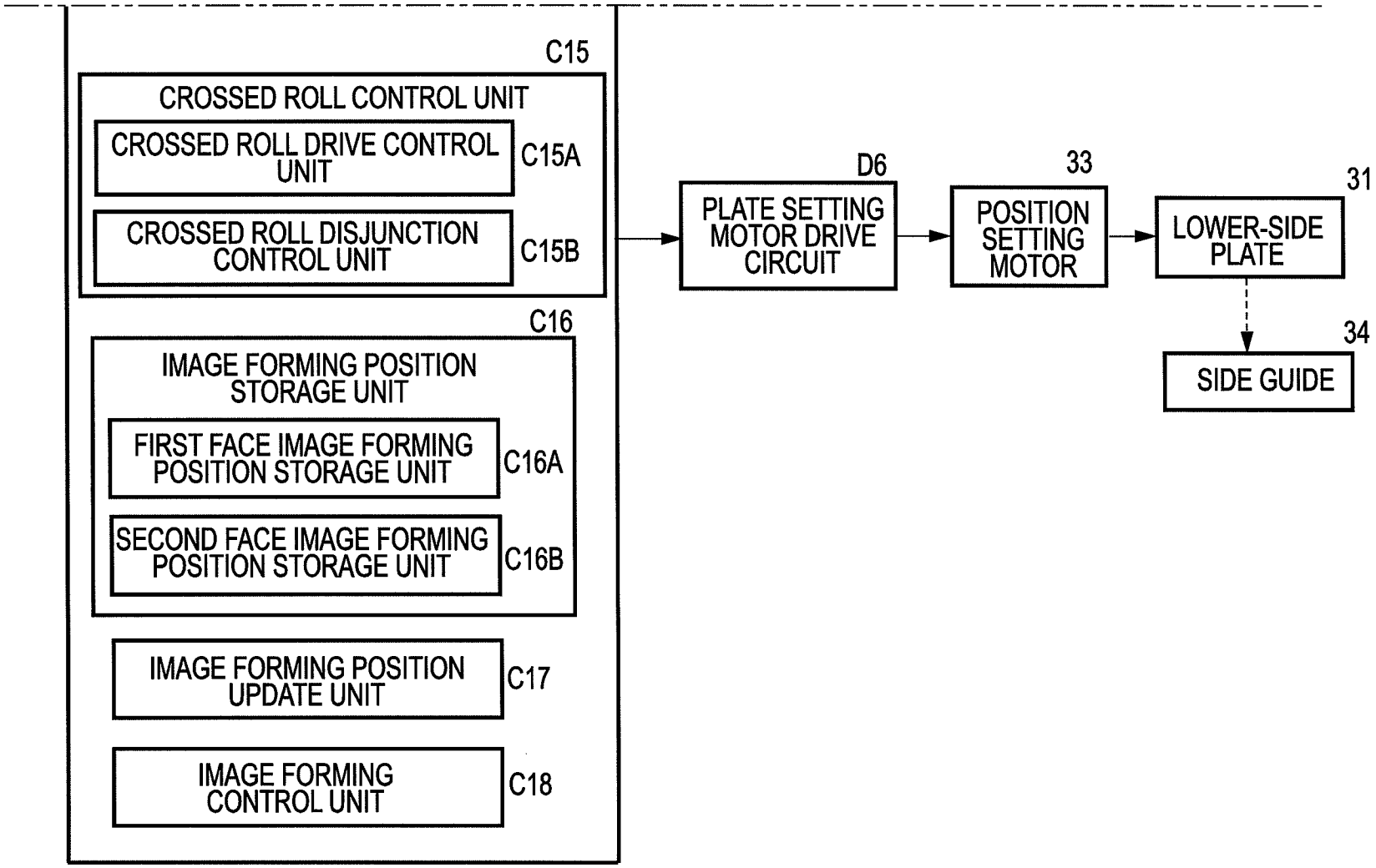

INITIAL SETTING PROCESS (FIG.16 Continued)
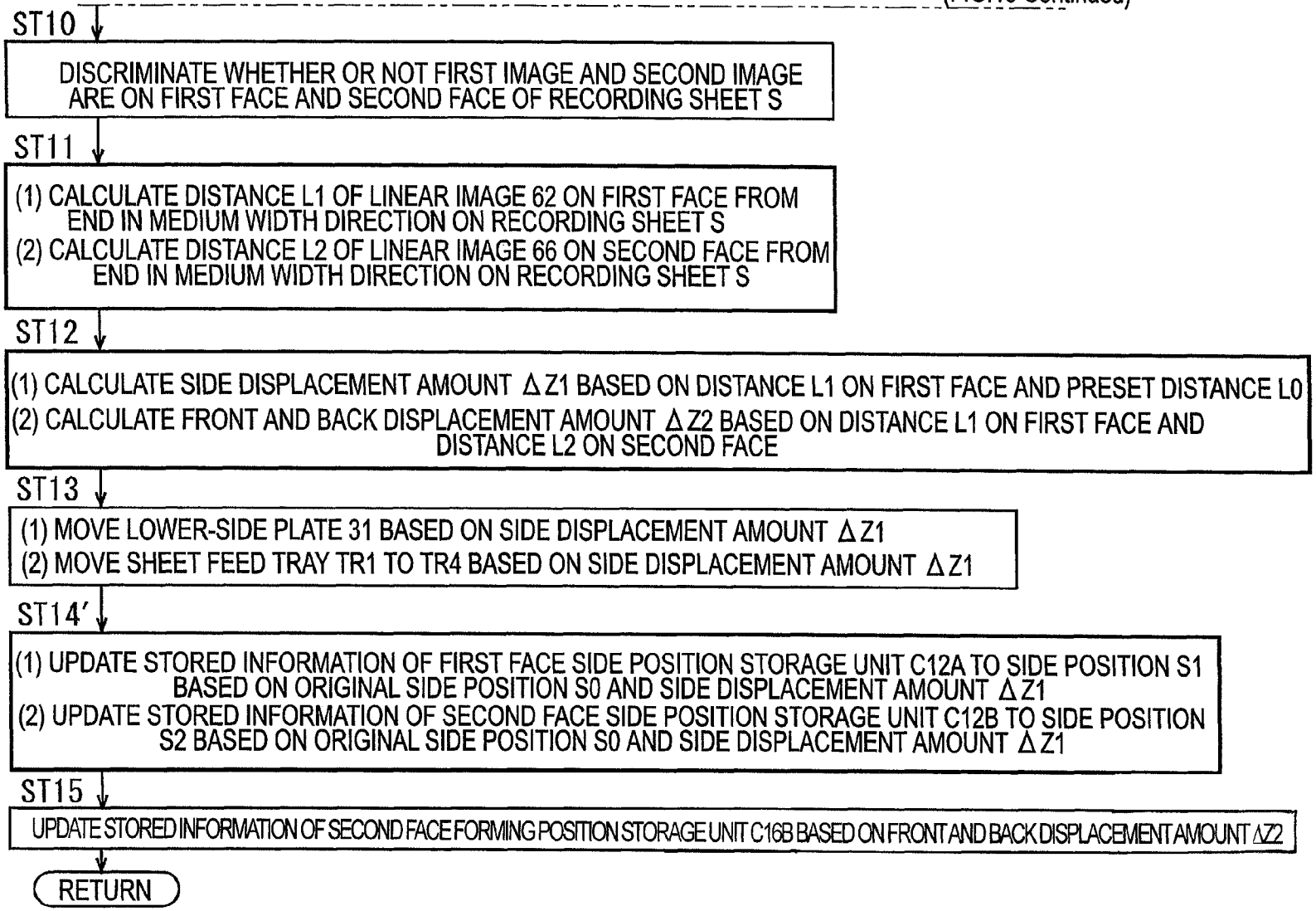

MEDIUM TRANSPORTING DEVICE AND IMAGE FORMING DEVICE

CROSS-REFERENCE TO RELATED APPLICATION

This application is based on and claims priority under 35 USC 119 from Japanese Patent Application No. 2009-121962 filed on May 20, 2009.

BACKGROUND

1. Technical Field

The present invention relates to a medium transporting device and an image forming device.

2. Related Art

In an image forming device, a technique for adjusting the timing of transporting a medium or the attitude of the medium is employed to prevent an image from being recorded on the medium in a displaced or inclined state.

SUMMARY

According to an aspect of the invention, a medium transporting device includes: a transporting path on which a medium is transported; a contacted member that is provided on the transporting path to be movable in a medium width direction orthogonal to a medium transporting direction, and is contacted by an end of the medium transported on the transporting path in the medium width direction; a line-up member on the transporting path that lines up a position of the medium by sending the medium transported on the transporting path to the contacted member to bring the end of the medium in the medium width direction into contact with the contacted member; a displacement amount calculation unit that sets on a downstream side of the line-up member in the medium transporting direction, and calculates a misregistration amount of the medium in the medium width direction based on a position of an image recorded on the medium and a reference position of a reference image in an image recording area where the image is recorded on the medium; and a contacted position control unit that controls a position of the contacted member by moving the contacted member in a direction of reducing the misregistration amount based on the misregistration amount calculated by the displacement amount calculation unit.

BRIEF DESCRIPTION OF THE DRAWINGS

Exemplary embodiments of the invention will be described in detail based on the following figures, wherein:

FIGS. 9A and 9B are explanatory views of a correction image recorded on the recording sheet, wherein FIG. 9A is an explanatory view of a first face correction image and FIG. 9B is an explanatory view of a second face correction image;

FIGS. 10A and 10B are explanatory views of an image input device and a recording sheet, wherein FIG. 10A is an explanatory view before the recording sheet is laid, FIG. 10B is an explanatory view in which the recording sheet is laid so that the first face may be read.

FIGS. 11A and 11B are explanatory views of a correction image recorded on the recording sheet and the misregistration amount, wherein FIG. 11A is an explanatory view of a side displacement amount and FIG. 11B is an explanatory view of a front and back displacement amount;

FIGS. 13A and 13B are explanatory views of the positional changes of a side guide, a crossed roll and a sheet feed tray in the medium width direction before and after the initial setting process, wherein FIG. 13A is an explanatory view of the positions before the initial setting process is performed and FIG. 13B is an explanatory view of the positions after the initial setting process is performed;

DETAILED DESCRIPTION

Figure 1:
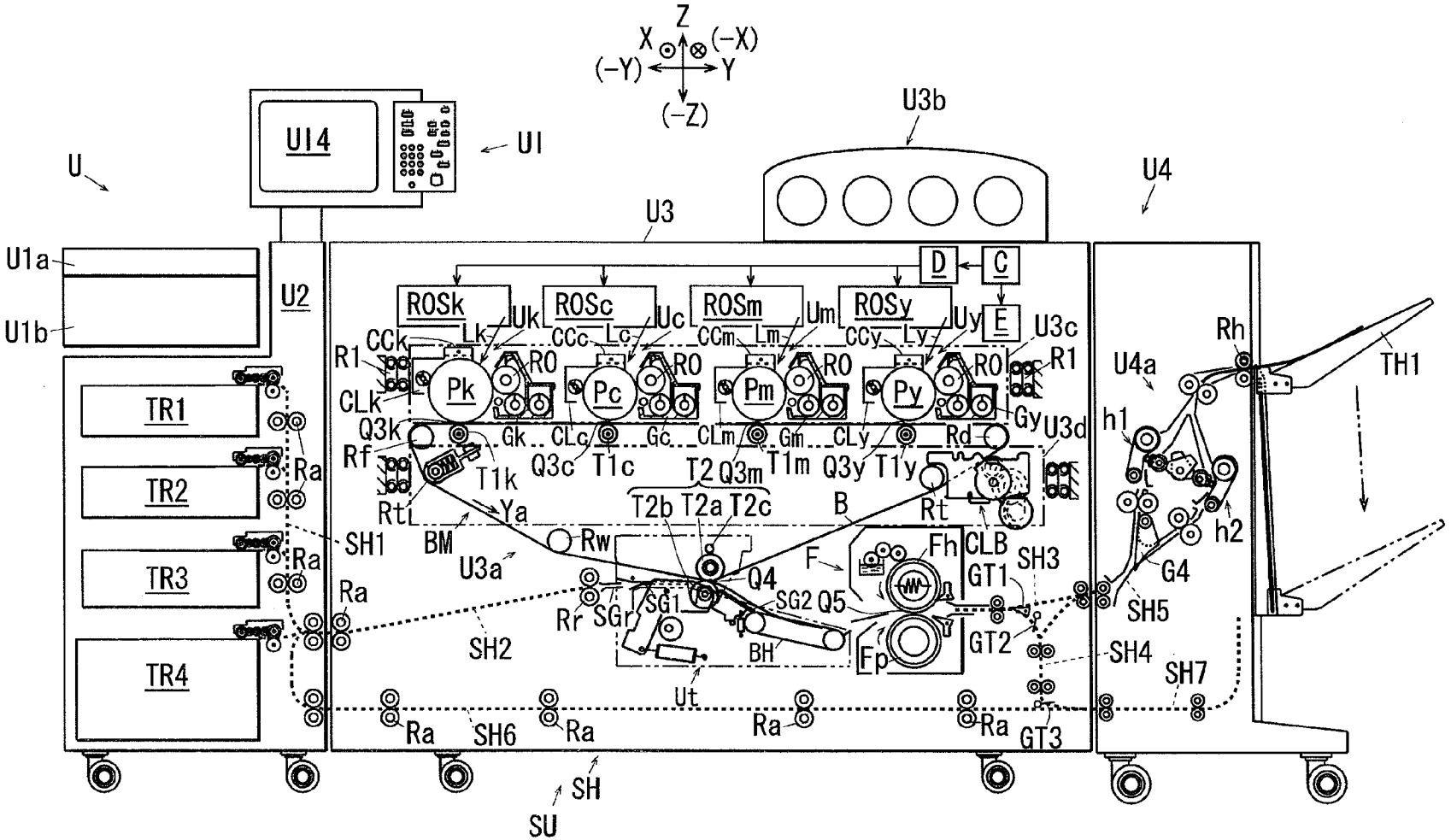
FIG. 1 is an overall explanatory view of an image forming device according to an exemplary embodiment 1 of the present invention.

The specific exemplary embodiments (hereinafter described as the exemplary embodiments) of the present invention will be described below with reference to the drawings, but the invention is not limited to the following exemplary embodiments.

To facilitate an understanding of the following explanation, it is assumed that the longitudinal direction is an X-axis direction, the lateral direction is a Y-axis direction, and the vertical direction is a Z-axis direction in the drawings. Also, it is assumed that the direction or side as indicated by the arrow X, −X, Y, −Y, Z or −Z is defined as the front, rear, right, left, upper or lower, or the front side, rear side, right side, left side, upper side or lower side.

Also, it is assumed that the symbol "•" in "○" means the arrow going from the back to the front of the page and the symbol "x" in "○" means the arrow going from the front to the back of the page in the drawings.

In the following explanation with the drawings, the illustration except for the members required for the easy understanding is appropriately omitted.

Exemplary Embodiment 1

FIG. 1 is an overall explanatory view of an image forming device according to an exemplary embodiment 1 of the invention.

In FIG. 1, the image forming device U has a user interface UI as one example of an operation part, an image input device U as one example of an image information input device, a sheet feeder U2, an image forming device main body U3 and a sheet processing device U4.

The user interface UI has the input buttons of a copy start key, a ten key and a copy count input key, and a display panel UI4.

The image input device U1 comprises an automatic original transporting device U1*a* and an image scanner U1*b* as one example of an image reading part. In FIG. 1, in the image input device U1, an original, not shown, is read and converted into image information which is inputted into the image forming device main body U3.

The sheet feeder U2 has the sheet feed trays TR1 to TR4 as one example of plural of medium receiving parts and a sheet feed path SH1 for taking out and transporting the recording sheet S as one example of the medium received in each sheet feed tray TR1 to TR4 to the image forming device main body U3.

In FIG. 1, the image forming device main body U3 has an image recording part U3*a* for recording the image on the recording sheet S transported from the sheet feeder U2, a toner dispenser device U3*b* as one example of a developer supply device, and a sheet transporting path SH2, a sheet exhaust path SH3, a sheet reversing path SH4 and a sheet circulating path SH6 as one example of the transporting path. The image recording part U3*a* will be described below.

Also, the image forming device main body U3 has a controller C as one example of the control part, a laser drive circuit D as one example of a latent image write device drive circuit controlled by the controller C, and a power circuit E controlled by the controller C. The laser drive circuit D, of which the operation is controlled by the controller C, outputs a laser drive signal according to the image information of Y (yellow), M (magenta), C (cyan) and K (black) inputted from the image input device U1 to a latent image forming device ROSy, ROSm, ROSc and ROSk for each color at a predetermined timing.

Beneath the latent image forming device ROSy, ROSm, ROSc and ROSk for each color, an image forming unit drawing member U3*c* is supported to be movable between a withdrawn position where it is withdrawn in front of the image forming device main body U3 and a mounted position where it is mounted inside the image forming device main body U3 by a pair of left and right guide members R1, R1.

Figure 2:
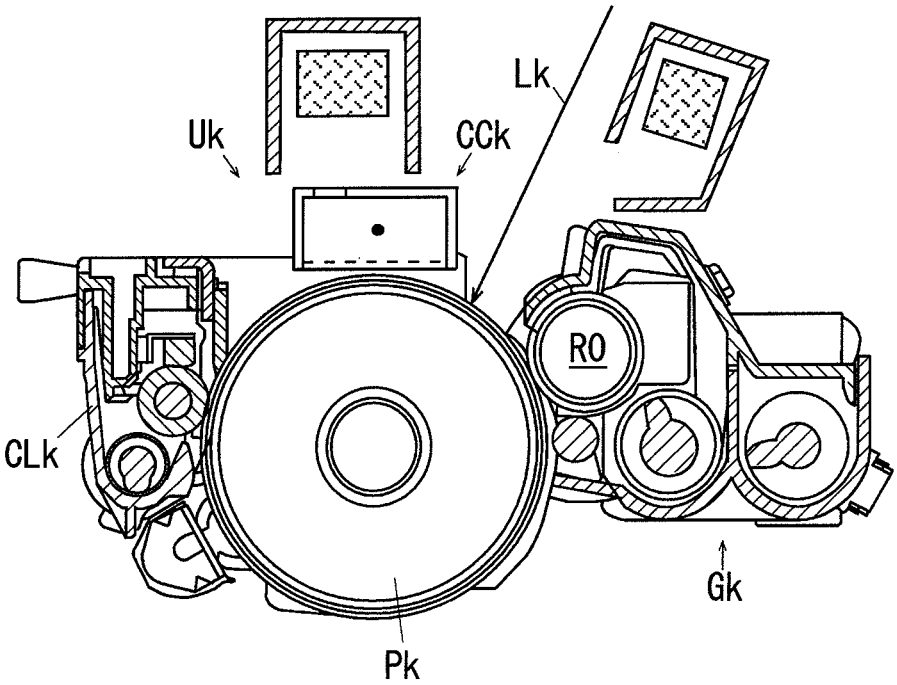
FIG. 2 is an explanatory view of a visible image forming member having an image carrier unit and a developing unit.

FIG. 2 is an explanatory view of a visible image forming member having an image carrier unit and a developing unit.

In FIGS. 1 and 2, the image carrier unit Uk of K color has an image carrier Pk, a charger unit CCk as one example of a discharger, and a cleaner CLk as one example an image carrier cleaner. And the image carrier units Uy, Um and Uc of other colors Y, M and C have also the image carriers Py, Pm and Pc, the charger units CCy, CCm and CCc and the cleaners CLy, CLm and CLc. In the exemplary embodiment 1, the image carrier Pk of K color having high use frequency and greatly abrasive on the surface is constructed in a larger diameter, making higher rotation speed and longer life, than the image carriers Py, Pm and Pc of other colors.

Each visible image forming member Uy+Gy, Um+Gm, Uc+Gc and Uk+Gk is composed of each image carrier unit Uy, Um, Uc and Uk and each developing unit Gy, Gm, Gc and Gk having a developing roll R0. The image carrier units Uy, Urn, Uc and Uk and the developing units Gy, Gm, Gc and Gk are removably mounted on the image forming unit drawing member U3*c*.

In FIG. 1, after the image carriers Py, Pm, Pc and Pk are uniformly charged by the charger units CCy, CCm, CCc and CCk, an electrostatic latent image is formed on the surface by a laser beam Ly, Lm, Lc and Lk as one example of a latent image write light outputted by the latent image forming device ROSy, ROSm, ROSc and ROSk. The electrostatic latent image on the surface of the image carrier Py, Pm, Pc and Pk is developed into a toner image of Y (yellow), M (magenta), C (cyan) and K (black) by the developing unit Gy, Gm, Gc and Gk.

The toner image on the surface of the image carrier Py, Pm, Pc and Pk is transferred successively and overlaid onto an intermediate transfer belt B as one example of an intermediate transfer body in a primary transfer area Q3*y*, Q3*m*, Q3*c* and Q3*k* by a primary transfer roll T1*y*, T1*m*, T1*c* and T1*k* as one example of a primary transfer unit, so that a multi-color image, or a so-called color image, is formed on the intermediate transfer belt B. The color image formed on the intermediate transfer belt B is transported to a secondary transfer area Q4.

In the case of only the black image data, the image carrier Pk and the developing unit Gk for K (black) color are simply used, so that the toner image of black is only formed.

After the primary transfer, the residual toner on the surface of the image carrier Py, Pm, Pc and Pk is cleaned out by the image carrier cleaner CLy, CLm, CLc and CLk.

Beneath the image forming unit drawing member U3*c*, an intermediate transfer body drawing member U3*d* is supported to be movable between a withdrawn position where it is withdrawn in front of the image forming device main body U3 and a mounted position where it is mounted inside the image forming device main body U3. A belt module BM as one example of the intermediate transfer device is supported to be movable up or down between an up position in contact with the lower surface of the image carrier Py, Pm, Pc and Pk and a down position away downward from the lower surface by the intermediate transfer body drawing member U3*d*.

The belt module BM has the intermediate transfer belt B, a belt support roll (Rd, Rt, Rw, Rf, T2*a*) as one example of an intermediate transfer body support member, and the primary transfer roll T1*y*, T1*m*, T1*c* and T1*k*. The belt support roll (Rd, Rt, Rw, Rf, T2*a*) has a belt drive roll Rd as one example of the intermediate transfer body drive member, a tension roll Rt as one example of a tension application member, a walking roll Rw as one example of a meandering prevention member, plural of idler rolls Rf as one example of a slave member, and a backup roll T2*a* as one example of a secondary transfer opposition member. And the intermediate transfer belt B is supported to be rotatable and movable in the arrow direction Ya by the belt support roll (Rd, Rt, Rw, Rf, T2*a*).

A secondary transfer unit Ut is arranged beneath the backup roll T2*a*. A secondary transfer roll T2*b* as one example of the secondary transfer member in the secondary transfer unit Ut is arranged to be separable from and contactable with the backup roll T2*a* across the intermediate transfer belt B, whereby a secondary transfer area Q4 as one example of the image recording area is formed by an area where the secondary transfer roll T2*b* is pressed against the intermediate transfer belt B. Also, a contact roll T2*c* as one example of a voltage application contact member contacts the backup roll T2*a*, whereby a secondary transfer unit T2 is composed of the rolls T2*a* to T2*c*.

The contact roll T2*c* is subjected to application of a secondary transfer voltage which has the same charge polarity with toner, from a power circuit controlled by the Controller C in a given timing.

The sheet transporting path SH2 as one example of the transporting path is arranged under the belt module BM. The recording sheet S supplied from the sheet feeder U2 is transported from the sheet feeding path SH1 to the sheet transporting path SH2 by a transporting roll Ra as one example of the transporting member. And the recording sheet is transported through a medium guide member SGr and a pre-transfer medium guide member SG1 to a secondary transfer area Q4 in synchronism with the timing when the toner image is transported to the secondary transfer area Q4 by the registration roll Rr as one example of the first transporting member and as one example of the transporting timing adjustment member.

The medium guide member SGr is secured to the image forming device main body U3 together with the registration roll Rr.

The toner image on the intermediate transfer belt B is transferred onto the recording sheet S by the secondary transfer unit T2 in passing through the secondary transfer area Q4. In the case of the full color image, the toner images primarily transferred and overlaid on the surface of the intermediate transfer belt B are secondarily transferred collectively onto the recording sheet S.

The intermediate transfer belt B after the secondary transfer is cleaned, or scavenged, by a belt cleaner CLB as one example of an intermediate transfer body cleaner unit. The secondary transfer roll T2*b* and the belt cleaner CLB are supported to be separable from and contactable with the intermediate transfer belt B.

The transfer device T1+B+T2+CLB for transferring the image on the surface of the image carriers Py to Pk onto the recording sheet S is constituted of the primary transfer rolls T1*y*, T1*m*, T1*c* and T1*k*, the intermediate transfer belt B, the secondary transfer unit T2 and the belt cleaner CLB.

The image recording part U3*a* of the exemplary embodiment 1 is constituted of the visible image forming members Uy+Gy to Uk+Gk and the transfer device T1+B+T2+CLB.

The recording sheet S onto which the toner image is secondarily transferred is transported through a post-transfer medium guide member SG2 and a sheet transporting belt BH as one example of a pre-fixing medium transporting member to a fixing device F. The fixing device F has a heating roll Fh as one example of a heating fixing member and a pressure roll Fp as one example of a pressure fixing member, whereby a fixing area Q5 is formed by an area where the heating roll Fh and the pressure roll Fp are contacted under pressure.

The toner image on the recording sheet S is heated and fixed by the fixing device F in passing through a fixing area Q5. A transporting path switching member GT1 is provided on the downstream side of the fixing device F. The transporting path switching member GT1 selectively switches the recording sheet S transported on the sheet transporting path SH2 and heated and fixed in the fixing area Q5 to a sheet exhaust path SH3 or a sheet reversing path SH4. The sheet S transported to the sheet exhaust path SH3 is transported to a sheet transporting path SH5 of the sheet processing device U4.

A curl correction device U4*a* is disposed in the middle of the sheet transporting path SH5, and a switching gate G4 as one example of the transporting path switching member is disposed on the sheet transporting path SH5. The switching gate G4 transports the recording sheet S transported from the sheet transporting path SH3 of the image forming device main body U3 to a first curl correction member h1 or a second curl correction member h2 in accordance with the direction of a curvature, or what is called a curl. The recording sheet S transported to the first curl correction member h1 or the second curl correction member h2 has the curl corrected at the time of passing through it. The recording sheet S with the curl corrected is exhausted from the exhaust roll Rh as one example of the exhaust member to the sheet output tray TH1 as one example of the exhaust part in the sheet processing device U4 in a state where the image fixed face of the sheet is upwardly directed, or what is called a face up state.

The recording sheet S transported to the sheet reversing path SH4 of the image forming device main body U3 by the transporting path switching member GT1 is passed in the manner of pushing away a transporting direction regulation member, or what is called a Mylar gate GT2, made of an elastic thin film member, and transported to the sheet reversing path SH4 of the image forming device main body U3.

The sheet circulating path SH6 and the sheet reversing path SH7 of the sheet processing device U4 are connected on the downstream side of the sheet reversing path SH4 in the image forming device main body U3, wherein a Mylar gate GT3 is also disposed on the connection part. The sheet transported through the switching gate GT1 to the sheet transporting path SH4 is transported through the Mylar gate GT3 to the sheet reversing path SH7. In the case of the double-sided printing, after the recording sheet S transported on the sheet reversing path SH4 is once transported directly through the Mylar gate GT3 to the sheet reversing path SH7, it is transported in the opposite direction, or what is called switched back and regulated in the transporting direction through the Mylar gate GT3, so that the switched back recording sheet S is transported to the sheet circulating path SH6. The recording sheet S transported to the sheet circulating path SH6 is resent through the sheet feed path SH1 to the transfer area Q4.

The sheet reversing path SH4+SH6+SH7 as one example of the reversing path of the exemplary embodiment 1 is composed of the sheet reversing path SH4, the sheet circulating path SH6 and the sheet reversing path SH7.

On the other hand, if the recording sheet S transported on the sheet reversing path SH4 is switched back after the trailing edge of the recording sheet S passes through the Mylar gate GT2, and before it passes through the Mylar gate GT3, the transporting direction of the recording sheet S is regulated by the Mylar gate GT2, so that the recording sheet S is turned over and transported to the sheet transporting path SH5. The recording sheet S turned over has the curl corrected by the curl correction device U4*a*, and is exhausted into the sheet output tray TH1 of the sheet processing device U4 in a state where the image fixed face of the sheet S is directed downward, or what is called a face down state.

The sheet transporting path SH is composed of the elements as indicated by the signs SH1 to SH7. Also, a sheet transporting device SU as one example of the medium transporting device is composed of the elements as indicated by the signs SH, Ra, Rr, Rh, SGr, SG1, SG2, BH, GT1 to GT3 and C.

(Explanation of the Sheet Feeder U2)

Figure 3:
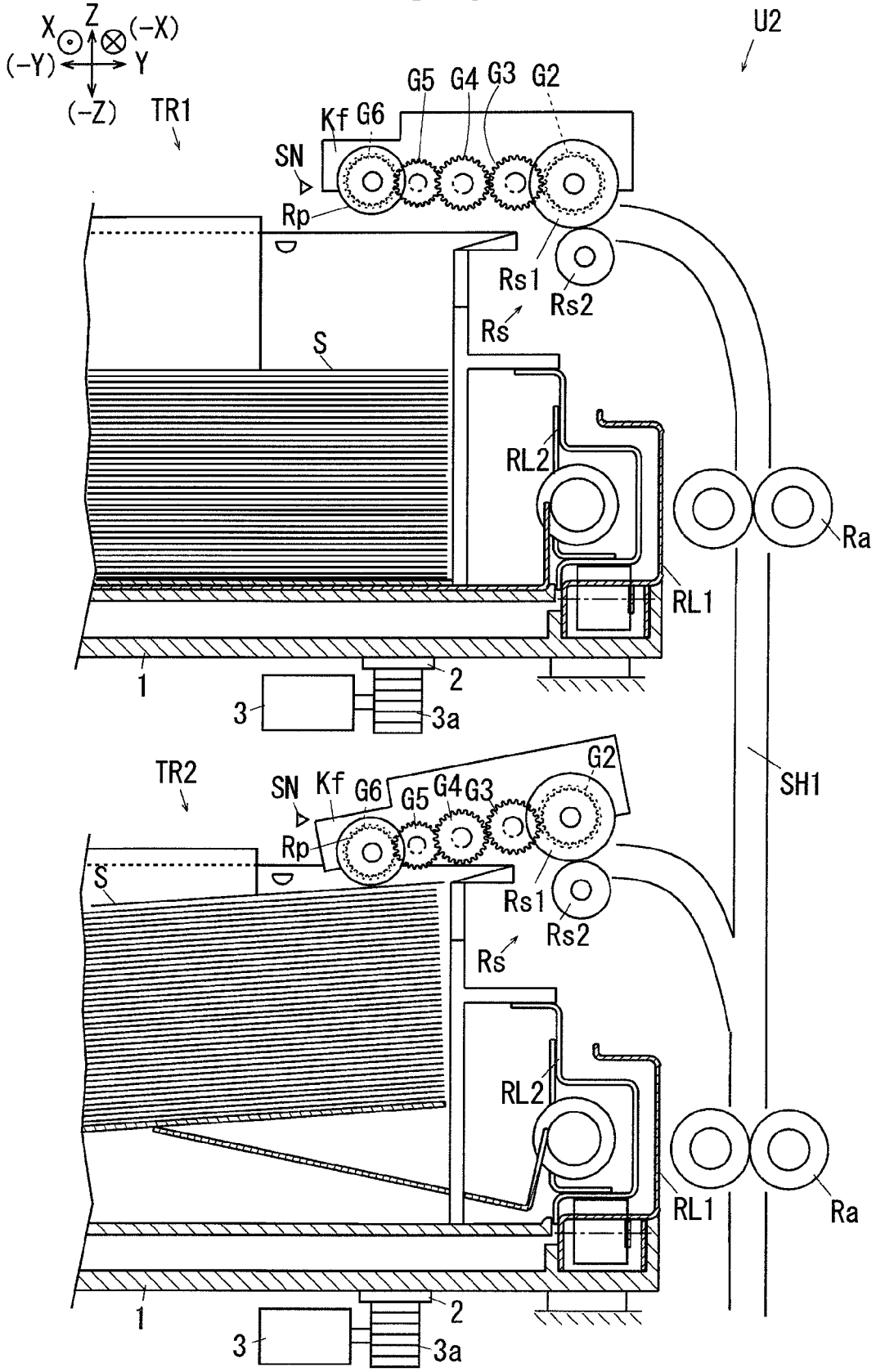
FIG. 3 is an enlarged view of the essence of a sheet feeder according to the exemplary embodiment 1.

FIG. 3 is an enlarged view of the essence of the sheet feeder according to the exemplary embodiment 1.

In FIG. 3, the sheet feeder U2 is provided with a support base 1 for removably supporting each of the sheet feed trays TR1 to TR4 to be movable in the longitudinal direction. A rail RL1 as one example of the guide member for guiding each of the sheet feed trays TR1 to TR4 is securely supported on the support base 1. Also, a rack 2 as one example of the transmitted part is formed on the lower face of the support base 1. A drive gear 3*a* of a position setting motor 3 as one example of a drive source supported by the sheet feeder U2 is meshed with the rack 2, so that the support base 1 is moved forth and back by receiving a drive force from the position setting motor 3.

In FIG. 3, a sheet feed frame Kf as one example of a sheet feed lift frame that rotatably supports a pickup roll Rp as one example of a medium delivery member and a feed roll Rs1 as one example of a downstream transporting member is arranged on the upper right side of each of the sheet feed trays TR1 to TR4. The gear trains G2 to G6 for transmitting a rotational force of a sheet feed drive motor as one example of a delivery drive source, not shown, to the pickup roll Rp and the feed roller Rs1 are arranged on the sheet feed frame Kf. An optical sensor SN for detecting the position of the sheet feed frame Kf as one example of the detection member is supported to the left of the sheet feed frame Kf.

Such a lift mechanism of the sheet feed frame Kf has been described in JP-A-2000-229737 or JP-A-2001-323966, and well known, in which the detailed description and illustration are omitted.

The sheet feed frame Kf is held at a sheet feed wait position where it is rotated up without feeding sheet as indicated with the sheet feed tray TR1 on the upper side in FIG. 3 by a spring as one example of the frame raising member, not shown. Also, the sheet feed frame Kf is connected to a frame lift solenoid as one example of the frame lowering member, not shown, and moved between the sheet feed wait position and a sheet feed execution position where the pickup roll Rp contacts the top of a sheet bundle of the recording sheets S loaded on the sheet feed trays TR1 to TR4 at a preset pressure in feeding the paper as indicated in the sheet feed tray TR2 on the lower side of FIG. 3 by energizing or de-energizing, that is, turning on or off the frame lift solenoid under the control.

Thereby, the recording sheet S loaded on the sheet feed trays TR1 to TR4 is picked up at a delivery timing of delivering the sheet by the pickup roll Rp. And the recording sheets S, which are delivered one on another, are separated individually in passing through a handling area that is a contact area between the feed roll Rs1 as one example of the downstream transporting member and a retard roll Rs2 as one example of a medium deceleration member as one example of the downstream transporting member. The separated recording sheets are transported to the sheet feed path SH1 by the feed roll Rs1, and transported to the sheet transporting path SH2 of the image forming device main body U3 on the downstream side. A handling roll Rs as one example of the separation member of the exemplary embodiment 1 is composed of the feed roll Rs1 and the retard roll Rs2.

The sheet feeder U2 of the exemplary embodiment 1 is composed of the support base 1, the rack 2, the position setting motor 3, the pickup roll Rp, the handling roll Rs, the gear trains G2 to G6, the sheet feed frame Kf, and the sheet feed path SH1.

(Explanation of the Sheet Feed Trays TR1 to TR4)

Figure 4:
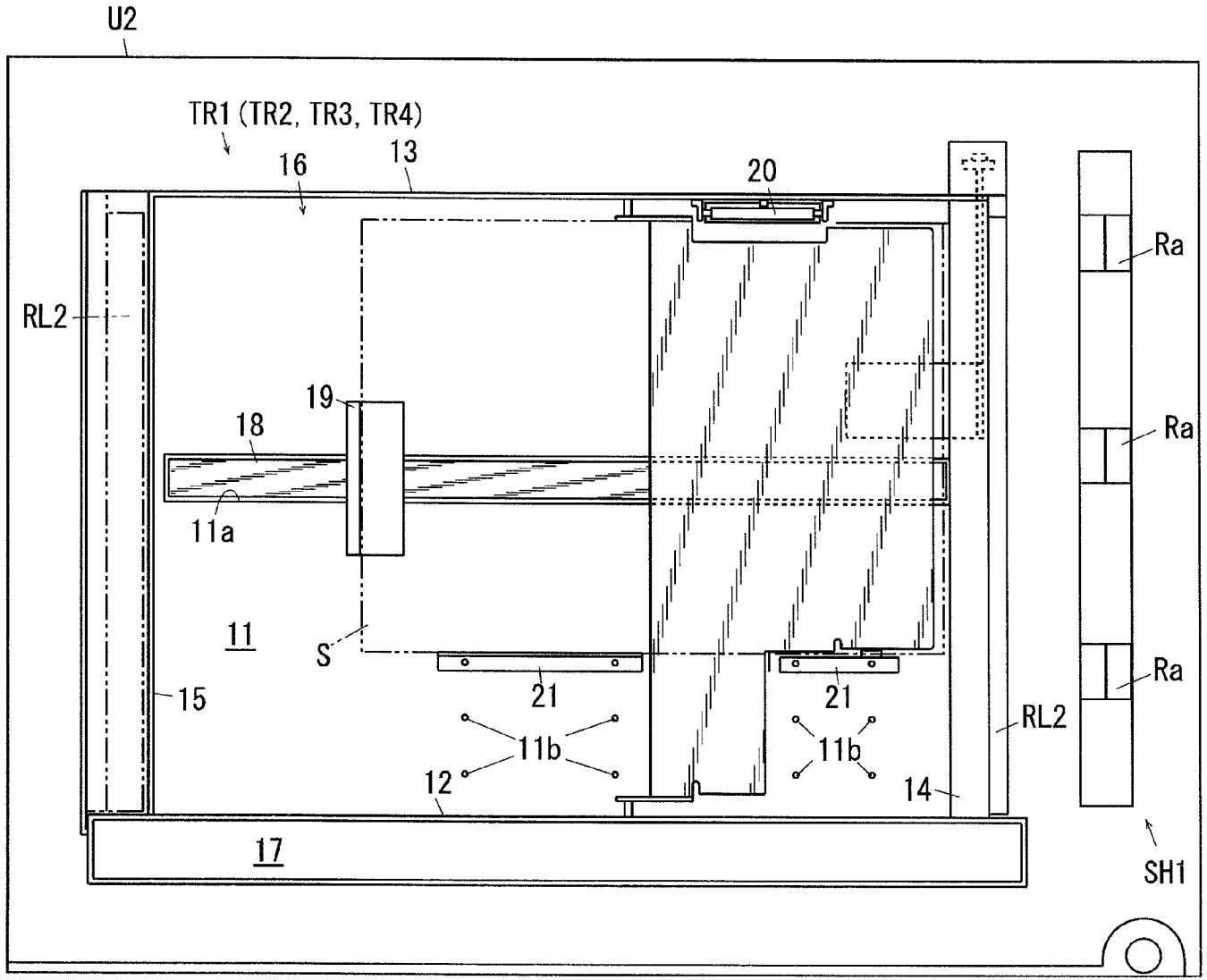
FIG. 4 is a plan view of a sheet feed tray according to the exemplary embodiment 1.
Figure 4:
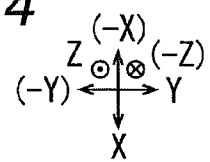

FIG. 4 is a plan view of the sheet feed tray according to the exemplary embodiment 1.

In FIGS. 3 and 4, each of the sheet feed trays TR1 to TR4 removably supported on the sheet feeder U2 of the exemplary embodiment 1 has a bottom wall 11, a front end wall 12, a read end wall 13, a right end wall 14 and a left end wall 15, in which a receiving space 16 as one example of a receiving part main body is composed of a space surrounded by the walls 11 to 15.

A pullout handle 17 as one example of a gripping part is supported on the front surface of the front end wall 12. Also, a guided member RL2 as one example of a guided part that is guided in contact with the rail RL1 is supported on the outer surface of the right end wall 14 and the left end wall 15.

In FIG. 4, a plate receiving groove 11*a* as one example of a support body receiving part extending in the medium transporting direction or the lateral direction is formed in the bottom wall 11. An end guide 18 as one example of a support body guide member is received in the plate receiving groove 11*a*. An end plate 19 for supporting the rear end or the left end of the received recording sheet S in the medium transporting direction as one example of a rear end support body is supported to be movable in the lateral direction on the end guide 18. Accordingly, the user can manually slide and adjust the position of the end plate 19 according to the dimension, or the so-called size, of the recording sheet S.

In FIG. 4, a rear side guide 20 as one example of a trailing edge supporting wall for contacting the trailing edge of the recording sheet S in the medium width direction and lining up the trailing edge of the recording sheet S is arranged on the rear side of the bottom wall 11.

Also, a front side guide 21 as one example of a front edge supporting wall for contacting the front edge of the recording sheet S in the medium width direction and lining up the front edge of the recording sheet S is supported on the front side of the bottom wall 11 to be removable from the bottom wall 11. The front side guide 21 can be manually mounted and dismounted by the user, in which the user can mount it at the position according to the size of the recording sheet S by inserting a projection formed on the lower surface of the front side guide 21 into a mount hole 11*b* formed in the bottom wall 11 according to the size of the recording sheet S.

Each of the sheet feed trays TR1 to TR4 of the exemplary embodiment 1 is composed of each of the members 11 to 21 and the guided member RL2.

Each of the sheet feed trays TR1 to TR4 is supported to be movable between a sheet feed position as shown in FIGS. 3 and 4 where it is mounted on the sheet feeder U2, supported on each support base 1, and a medium resupply position where it is moved to the front side of the support base 1 and pulled out of the sheet feeder U2.

Herein, in the case where the sheet feed trays TR1 to TR4 are held at the sheet feed position, if the position setting motor 3 is positively rotated, each of the sheet feed trays TR1 to TR4 is moved to the front side together with the support base 1, and if it is reversely rotated, each of the sheet feed trays TR1 to TR4 is moved to the rear side together with the support base 1, so that the position relative to the sheet feed frame Kf such as the pickup roll Rp is changed.

(Explanation of the Side Guide 34 and the Crossed Roll Rc)

Figure 5:
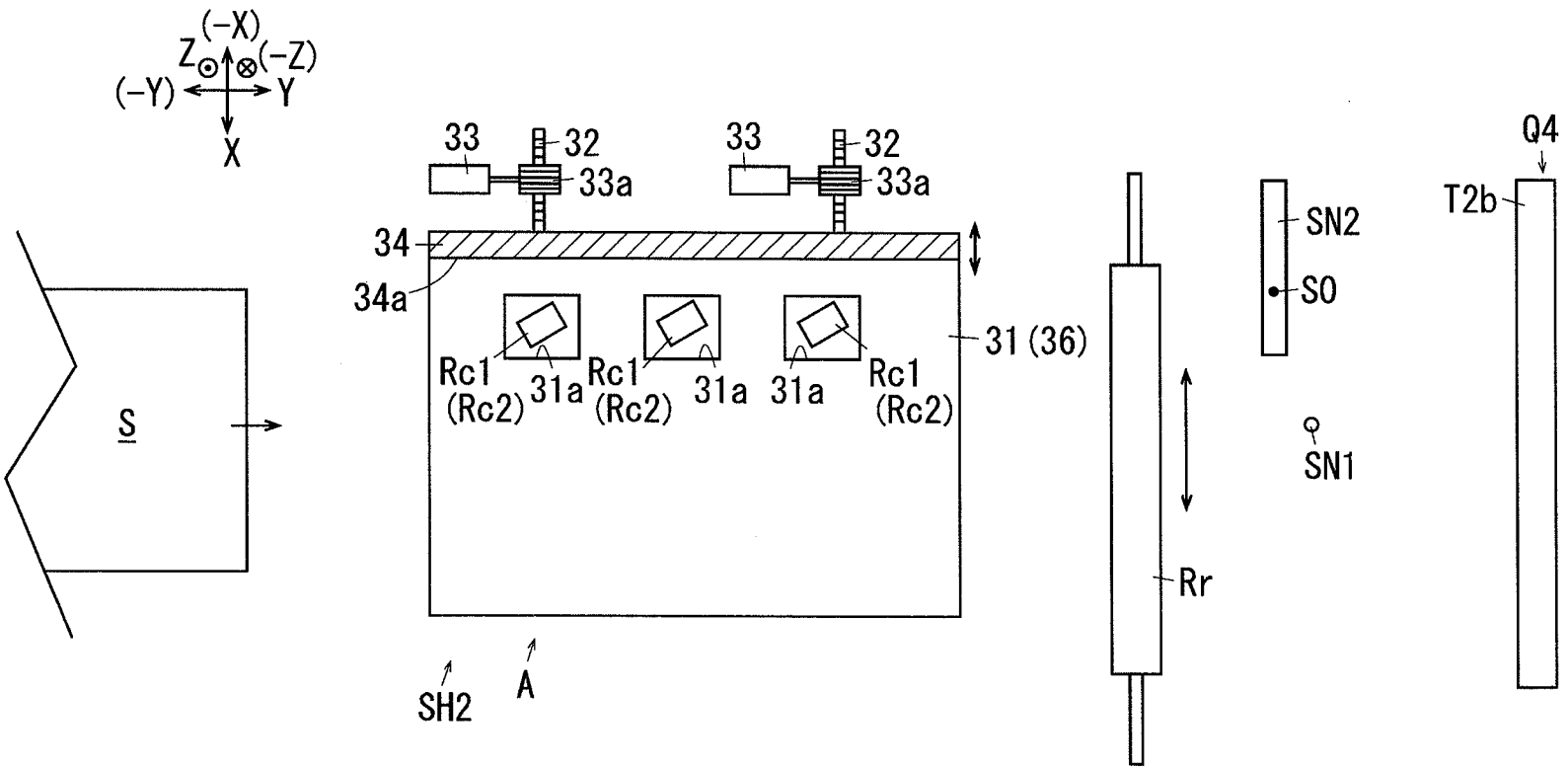
FIG. 5 is an explanatory view of a sheet transporting path, or a skew correction area.

FIG. 5 is an explanatory view of the sheet transporting path, or a skew correction area.

In FIG. 5, a skew correction area A as one example of an attitude correction area of the recording sheet S is set on the sheet transporting path SH2 on the downstream side of the sheet feeder U2.

A lower-side plate 31 as one example of a lower-side support member is disposed in the skew correction area A. A pair of left and right plate racks 32 as one example of the transmitted member extending rearward are formed in the lower-side plate 31. A drive gear 33*a* rotated by receiving a drive force of the position setting motor 33 as one example of the drive source is meshed with each of the plate racks 32.

A plate-like side guide 34 extending along the sheet transporting path SH2 and protruding upward as one example of a contacted member is provided at the rear end of the lower-side plate 31.

At the front surface of the side guide 34, a contact surface 34*a* capable of contacting with the end of the recording sheet S in the medium width direction which is orthogonally-crossed to the medium transporting direction, is formed.

Three roll opening portions 31*a* as one example of opening are formed in the lower-side plate 31 in front of the side guide 34. A drive crossed roll Rc1 as one example of a line-up member on the drive side is arranged under the roll opening portion 31*a*, and supported rotatably on the lower-side plate 31 so that the drive crossed roll Rc1 may protrude upward from the roll opening portion 31*a*.

At an upper end of the side guide 34, an upper-side plate 36 as one example of an upper-side support member opposed to the lower-side plate 31 is supported. The slave crossed roll Rc2 as one example of a line-up member on the slave side is rotatably supported on the upper-side plate 36 to be approachable to and separable from the drive crossed roll Rc1.

The crossed roll Rc as one example of the line-up member of the exemplary embodiment 1 is composed of the drive crossed roll Rc1 and the slave crossed roll Rc2. The crossed roll Rc sends the recording sheet S transported through the skew correction area A on the sheet transporting path SH2 to the side guide 34, and lines up the position of the recording sheet S by bringing the end of the recording sheet S in the medium width direction into contact with the side guide 34. Thereby, the recording sheet S is corrected for the attitude in the medium transporting direction, or what is called a skew.

Herein, if the position setting motor 33 is positively rotated, the side guide 34 and the crossed roll Rc are moved to the rear side together with the lower-side plate 31. Also, if the position setting motor 33 is reversely rotated, the side guide 34 and the crossed roll Rc are moved to the front side together with the lower-side plate 31.

Such a movement mechanism of the side guide 34 or the crossed roll Rc in the medium width direction is well known and described in JP-A-2005-112543, for example, in which the detailed description and illustration thereof are omitted.

(Explanation of the Registration Roll Rr)

Figure 6:
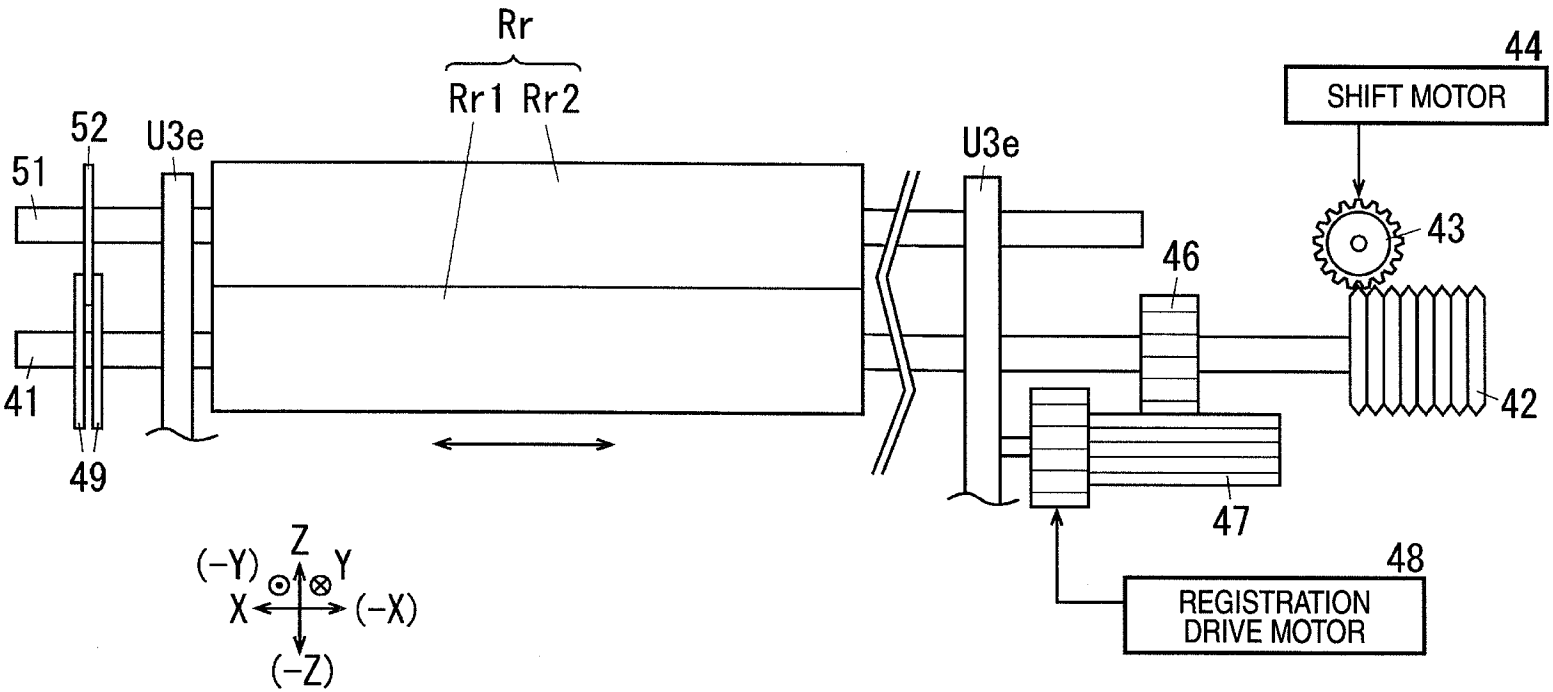
FIG. 6 is an explanatory view of a movement mechanism of a registration roll in the medium width direction.

FIG. 6 is an explanatory view of a movement mechanism of the registration roll in the medium width direction.

In FIG. 5, the registration roll Rr as one example of the first transporting member is disposed on the downstream side of the crossed roll Rc in the medium transporting direction and on the upstream side of the secondary transfer area Q4.

In FIG. 6, the registration roll Rr has a drive registration roll Rr1 as one example of the drive side member and a slave registration roll Rr2 as one example of the slave side member opposed to the drive registration roll Rr1.

The drive registration roll Rr1 has a drive side support shaft 41 extending in the longitudinal direction. The drive side support shaft 41 is supported rotatably to be movable in the medium width direction on a pair of front and back support parts U3*e* provided in the image forming device main body U2.

A shift rack 42 as one example of the first transmitted member is supported at the rear end of the drive side support shaft 41. The shift rack 42 is provided with a crest part and a valley part in the direction orthogonal to the drive side support shaft 41, in which even if the drive side support shaft 41 is rotated, the tooth position of the shift rack 42 in the medium width direction is held. The shift rack 42 is meshed with a shift gear 43 as one example of the first gear member, in which if the shift gear 43 is rotated, it is moved in the medium width direction. The shift gear 43 is rotated by receiving a drive force of a shift motor 44 as one example of the first drive source.

In the drive side support shaft 41, a driven gear 46 as one example of the second driven member is supported between the shift rack 42 and the rear side support part U3*e*. The driven gear 46 is meshed with an intermediate gear as one example of an intermediate transmission member longer in the longitudinal direction. The intermediate gear 47 is rotated by receiving a drive force of a registration drive motor 48 as one example of the second drive source. The length of the intermediate gear 47 in the longitudinal direction is set in accordance with the movement amount of the drive registration roll Rr1 in the medium width direction.

In the drive side support shaft 41, two disk-like holding members 49 are supported with a gap in front of the front side support part U3*e*.

The slave registration roll Rr2 has a slave side support shaft 51 extending in the longitudinal direction. The slave side support shaft 51, like the drive side support shaft 41, is supported rotatably to be movable in the medium width direction on the support part U3*e*. In the slave side support shaft 51, a disk-like held member 52 is supported, corresponding to a holding member 49 of the drive registration roll Rr1, in front of the front side support part U3*e*. The held member 52 is held in a state where it is sandwiched between the holding members 49. Thereby, the slave registration roll Rr2 is moved in the medium width direction together with the drive registration roll Rr1.

If the registration drive motor 48 rotates, the drive registration roll Rr1 is rotated via the gears 46 and 47, and the slave registration roll Rr2 in contact with the drive registration roll Rr1 is also driven and rotated.

Also, if the shift motor 44 is positively rotated, the drive registration roll Rr1 is moved forward via the shift gear 43 and the shift rack 42, and the slave registration roll Rr2 is also moved forward. And if the shift motor 44 is reversely rotated, the drive registration roll Rr1 is moved backward via the shift gear 43 and the shift rack 42, and the slave registration roll Rr2 is also moved backward.

That is, the registration roll Rr transports the recording sheet S transported on the sheet transporting path SH2 to the secondary transfer area Q4 and is movable in the medium width direction.

(Explanation of the Controller C of the Exemplary Embodiment 1)

Figure 7:
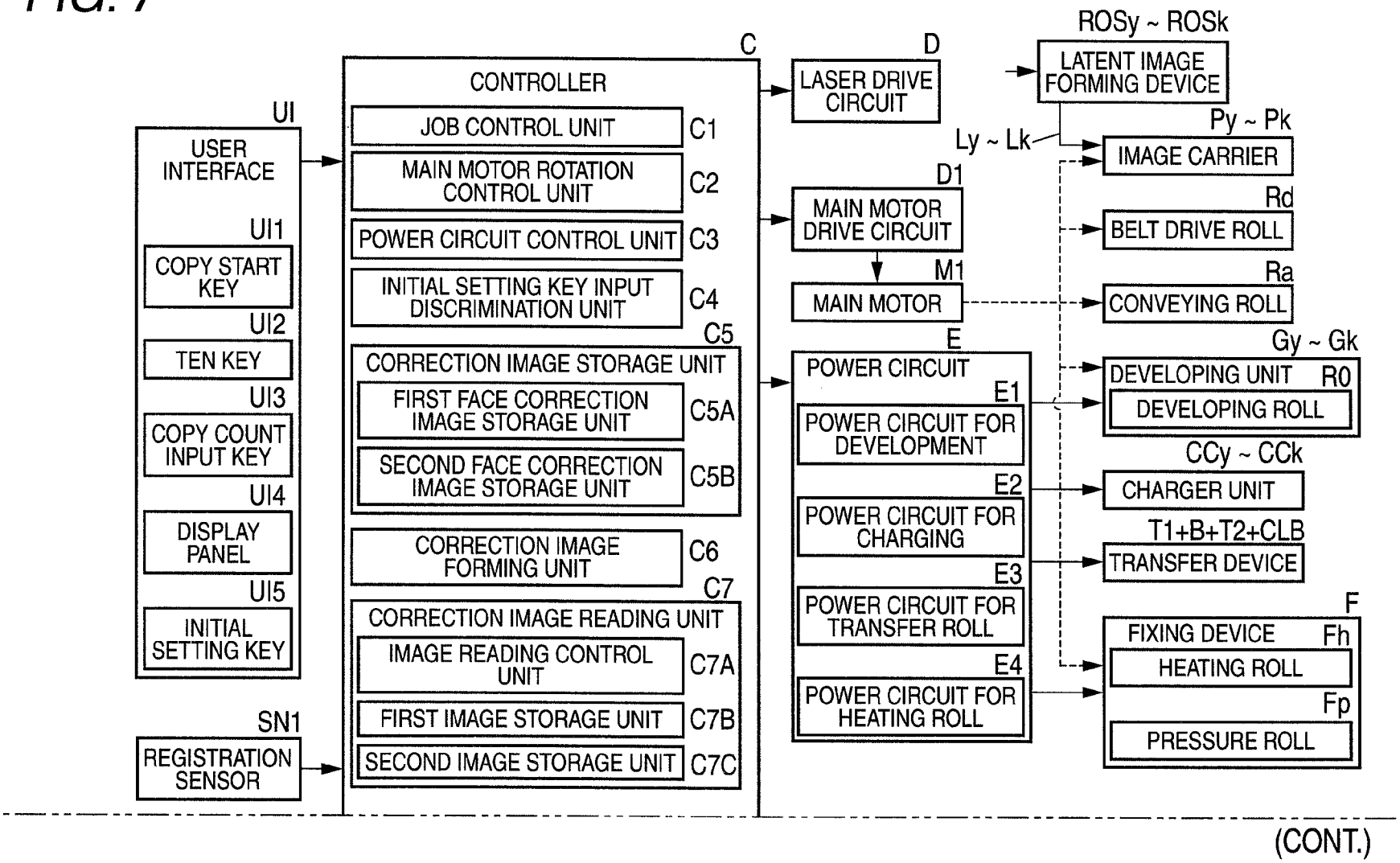
FIG. 7 is a block diagram of each function provided for a control part in the image forming device according to the exemplary embodiment 1.

FIG. 7 is a block diagram of each function provided for a control part in the image forming device according to the exemplary embodiment 1.

Figure 8:
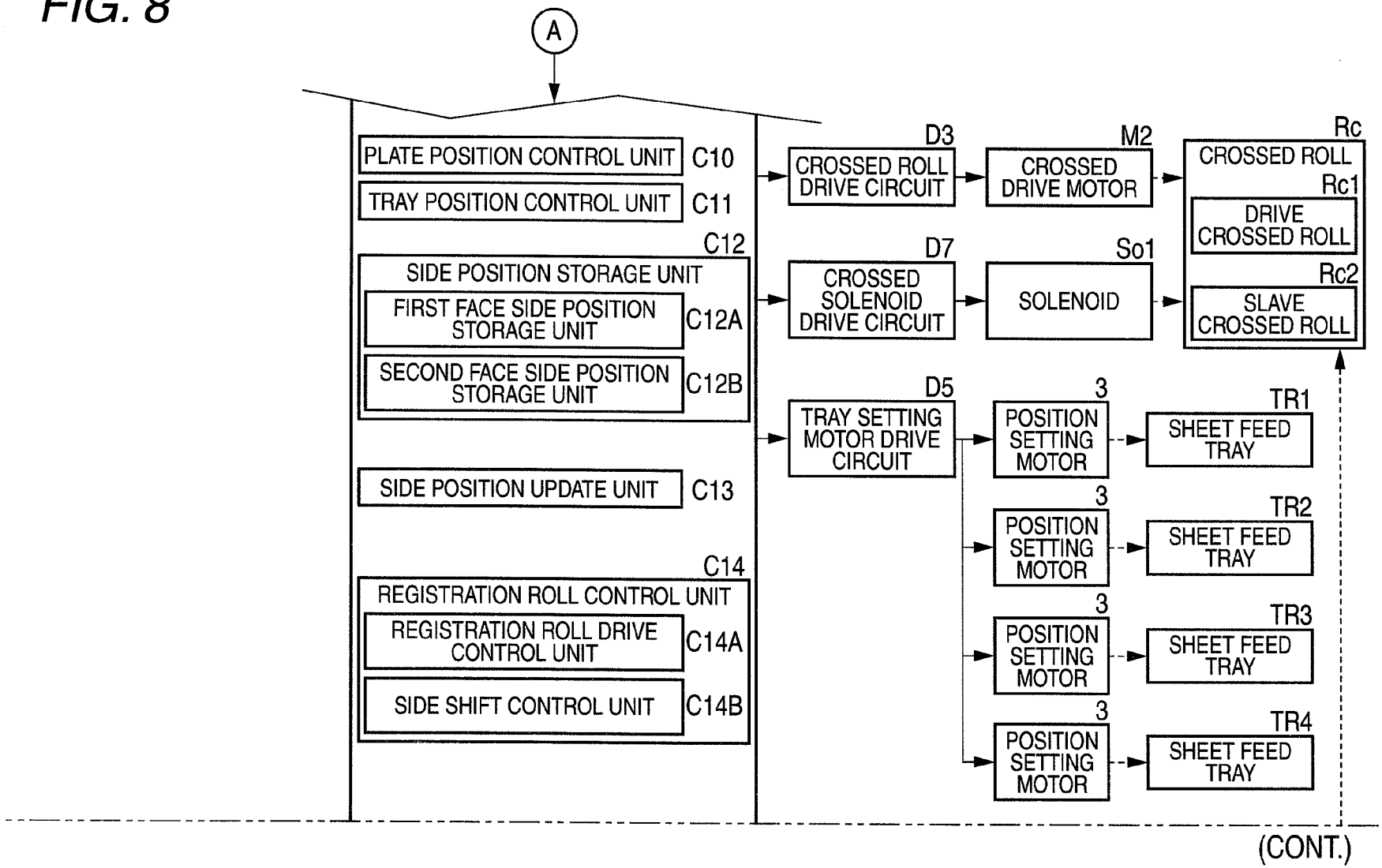
FIG. 8 is a block diagram of each function provided for the control part in the image forming device according to the exemplary embodiment 1, continued from FIG. 7.

FIG. 8 is a block diagram of each function provided for the control part in the image forming device according to the exemplary embodiment 1, continued from FIG. 7.

In FIGS. 7 and 8, the controller C comprises an input/output interface, or what is called an I/O, as one example of an input/output signal adjustment part for adjusting the input/output of a signal from/to the outside and the input/output signal level, a read-only memory, or what is called ROM, for storing a program and the data for performing the required process, a random access memory, or what is called RAM, for temporarily storing the required data, a central processing unit, or what is called CPU, for performing the processing according to the program stored in the ROM, and a computer as one example of a computing apparatus having a clock oscillator and so on. Various functions can be implemented by performing the program stored in the ROM.

(Signal Input Element Connected to the Controller C)

A signal is inputted from a signal input element such as a user interface UI, a registration sensor SN1 or a side sensor SN2 into the controller C.

UI: User Interface

The user interface UI is one example of an image reading start button, having a copy start key UI1 as one example of a copy start button, a ten key UI2 as one example of a number input button, a copy count input key UI3 as one example of a copy sheet number input button, a display panel UI4 as one example of the display part, and an initial setting key UI5 as one example of the initial setting input button, and inputs a detection signal into the controller C upon detecting the input of the key.

SN1: Registration Sensor

The registration sensor SN1 as one example of the first medium detection member is disposed on the downstream side of the registration roll Rr to detect the passage of the front end of the recording sheet S pinched by the registration roll Rr, as shown in FIG. 5.

SN2: Side Sensor

The side sensor SN2 as one example of the second medium detection member is disposed on the downstream side of the registration roll Rr to detect the position of the end of the recording sheet S in the medium width direction, as shown in FIG. 5.

(Control Elements Connected to the Controller C)

Also, the controller C is connected to a laser drive circuit D, a main motor drive circuit D1, a registration roll drive circuit D2, a crossed roll drive circuit D3, a shift motor drive circuit D4, a tray setting motor drive circuit D5, a plate setting motor drive circuit D6, a crossed roll disjunction drive circuit D7, a power circuit E, and other control elements, and outputs an operation control signal of them.

D: Laser Drive Circuit

The laser drive circuit D controls a latent image forming device ROSy to ROSk to form the latent image.

D1: Main Motor Drive Circuit

The main motor drive circuit D1 as one example of the drive circuit for the main drive source drives rotationally the image carriers Py to Pk, the developing roll R0 of the developing units Gy to Gk, the belt drive roll Rd and the fixing device F via a main motor M1 as one example of the main drive source.

D2: Registration Roll Drive Circuit

The registration roll drive circuit D2 as one example of the drive circuit for the first transporting member drives rotationally the registration roll Rr via the registration drive motor 48 that is controllable in the rotating speed.

D3: Crossed Roll Drive Circuit

The crossed roll drive circuit D3 as one example of the drive circuit for the line-up member drives rotationally the crossed roll Rc via a crossed drive motor M2 as one example of the drive source for the line-up member.

D4: Shift Motor Drive Circuit

The shift motor drive circuit D4 as one example of the drive circuit for the shift motor 44 moves, or what is called side-shifts, the registration roll Rr in the medium width direction by driving the shift motor 44.

D5: Tray Setting Motor Drive Circuit

The tray setting motor drive circuit D5 as one example of the drive circuit for the position setting motor 3 of the sheet feed trays TR1 to TR4 changes the position of each sheet feed tray TR1 to TR4 held at the sheet feed position in the medium width direction by driving the position setting motor 3 of each sheet feed tray TR1 to TR4.

D6: Plate Setting Motor Drive Circuit

The plate setting motor drive circuit D6 as one example of the drive circuit for the position setting motor 33 of the lower-side plate 31 changes the position of the lower-side plate 31 in the medium width direction by driving the position setting motor 33 of the lower-side plate 31.

Thereby, the positions of the side guide 34 and the crossed roll Rc in the medium width direction are also changed.

D7: Crossed Solenoid Drive Circuit

The crossed solenoid drive circuit D7 as one example of the disjunction drive circuit for the line-up member energizes or de-energizes a solenoid So1 as one example of an electromagnetic drive device, that is, turns it on or off, to make the slave crossed roll Rc2 separate from or contact with the drive crossed roll Rc1.

E: Power Circuit

The power circuit E has a developing power circuit E1, a charging power circuit E2, a transfer roll power circuit E3 and a heating roll power circuit E4.

E1: Developing Power Circuit The developing power circuit E1 applies a development voltage to the developing roll R0 of the developing unit G.

E2: Charging Power Circuit

The charging power circuit E2 applies a charging voltage to the charger units CCy, CCm, CCc and CCk.

E3: Transfer Roll Power Circuit

The transfer roll power circuit E3 applies a transfer voltage to the primary transfer roll T1*y*, T1*m*, T1*c* and T1*k* and the contact roll T2*c* in the transfer device T1+B+T2+CLB.

E4: Heating roll power circuit

The heating roll power circuit E4 applies a heating power to the heater as one example of the heating member of the heating roll Fh in the fixing device F.

(Functions of the Controller C)

The controller C has the following function implementation means of performing the process according to an output signal from each signal output element such as the user interface UI, the registration sensor SN1 or the side sensor SN2 and outputting a control signal to each control element.

C1: Job Control Means

Job control means C1 as one example of the image forming operation control means controls the operation of the latent image forming devices ROSy to ROSk, the image recording part U3*a*, the fixing device F and the sheet transporting device SU in accordance with the input of the copy start key UI1 to perform a job as one example of the image forming operation.

C2: Main Motor Rotation Control Means

Main motor rotation control means C2 as one example of the rotation control means for the main drive source controls the main motor drive circuit D1 to drive for rotation the image carriers Py to Pk, the developing units Gy to Gk, and the fixing device F.

C3: Power Circuit Control Means

Power circuit control means C3 controls the power circuit E to supply the voltage or current to the developing roll R0, the charger units CCy, CCm, CCc and CCk, the primary transfer rolls T1*y*, T1*m*, T1*c* and T1*k*, the contact roll T2*c*, and the heater of the heating roll Fh in the fixing device F.

Figure 9A:
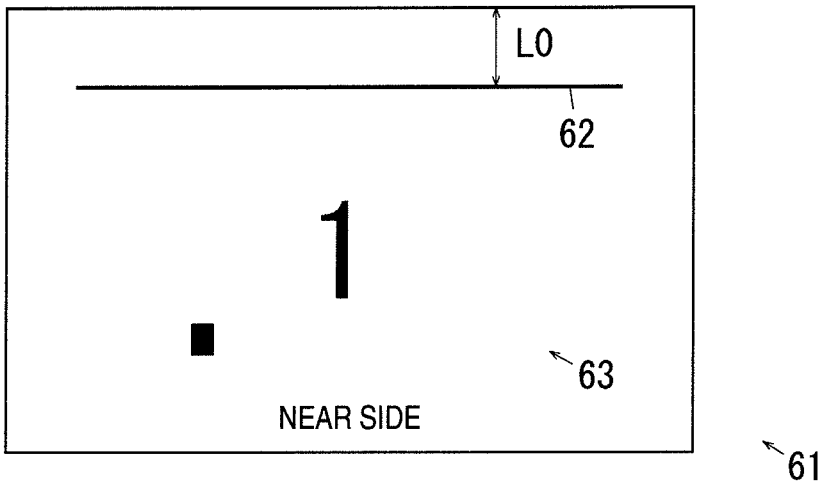
Figure 9B:
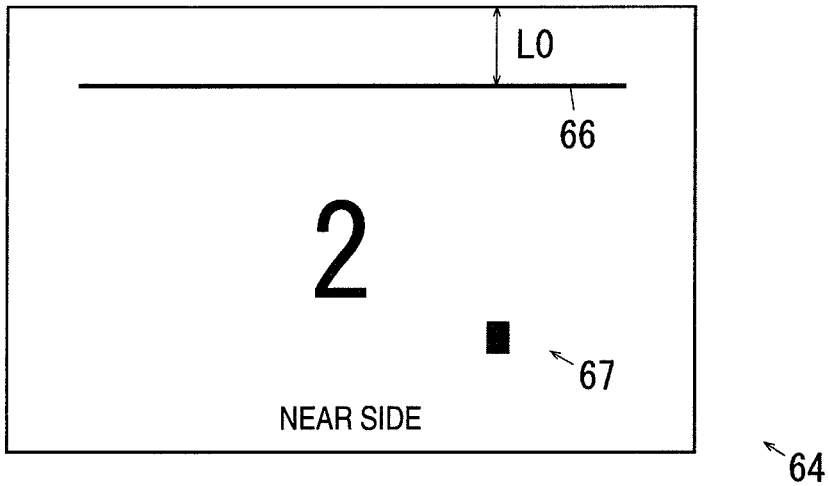

FIG. 9 is an explanatory view of a correction image recorded on the recording sheet, wherein FIG. 9A is an explanatory view of a first face correction image and FIG. 9B is an explanatory view of a second face correction image.

C4: Initial Setting Key Input Discrimination Means

Initial setting key input discrimination means C4 as one example of input discrimination means for the initial setting key UI5 discriminates whether or not the initial setting key UI5 is inputted.

C5: Correction Image Storage Means

Correction image storage means C5 has first face correction image storage means C5A and second face correction image storage means C5B, and stores the preset image information, or what is called the image data, which is used in setting the position of the sheet feed trays TR1 to TR4, the side guide 34 and the crossed roll Rc or setting the side-shift position of the registration roll Rr.

C5A: First Face Correction Image Storage Means

First face correction image storage means C5A as one example of reference image storage means stores the image data of a first face correction image 61 recorded on the first face of the recording sheet S.

In FIG. 9A, the first face correction image storage means C5A of the exemplary embodiment 1 stores the image data of the first face correction image 61 including a linear image 62 along the medium transporting direction as one example of the reference image and an instruction image 63 including an instruction to the operator at the time of reading the image. The linear image 62 is set as the image recorded at the position a preset distance L0 away from the end of the recording sheet S in the medium width direction.

C5B: Second Face Correction Image Storage Means

Second face correction image storage means C5B as one example of the second reference image storage means stores the image data of a second face correction image 64 recorded on the second face of the recording sheet S.

In FIG. 9B, the second face correction image storage means C5B of the exemplary embodiment 1 stores the image data of the second face correction image 64 including a linear image 66 corresponding to the linear image 62 of the first face correction image 61 and an instruction image 67 which is different from the instruction image 63 of the first face correction image 61 in that the purport of the second face is indicated.

C6: Correction Image Forming Means

Correction image forming means C6 records each correction image 61, 64 on the first face or the second face of the recording sheet S, based on the image data of each face correction image 61, 64 stored in the correction image storage means C5.

The correction image forming means C6 of the exemplary embodiment 1 causes the image forming means C1 to record the first face correction image 61 on the first face of the recording sheet S and record the second face correction image 64 on the second face of the recording sheet S.

Figure 10A:
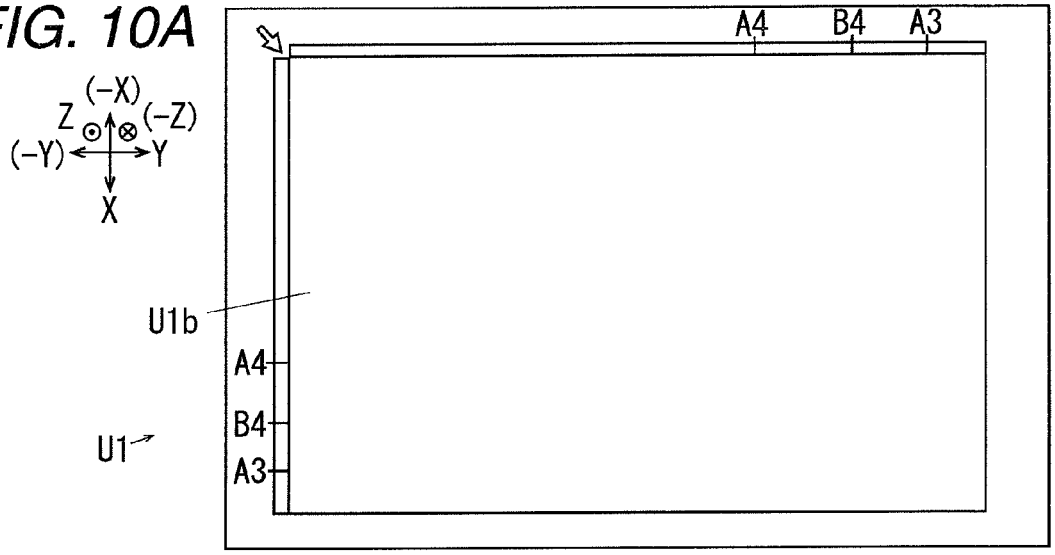
Figure 10B:
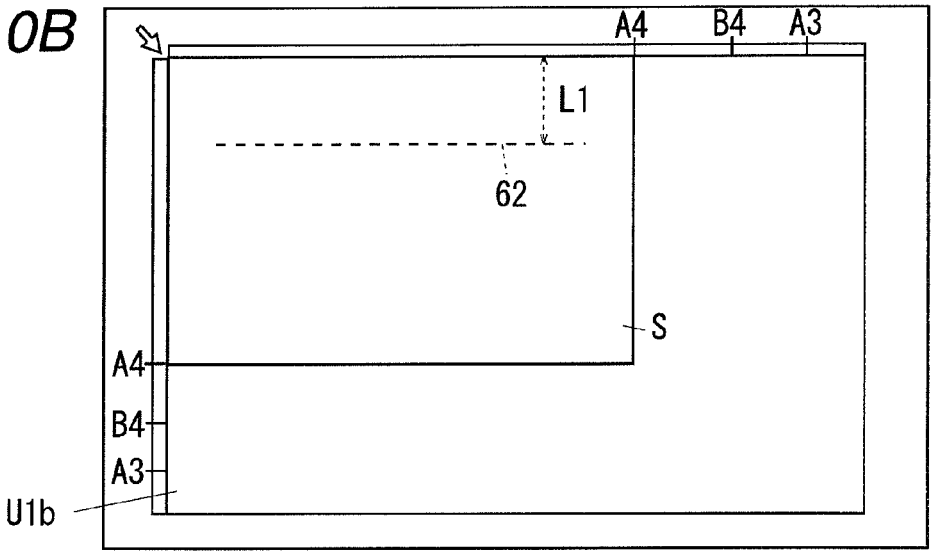
Figure 10C:
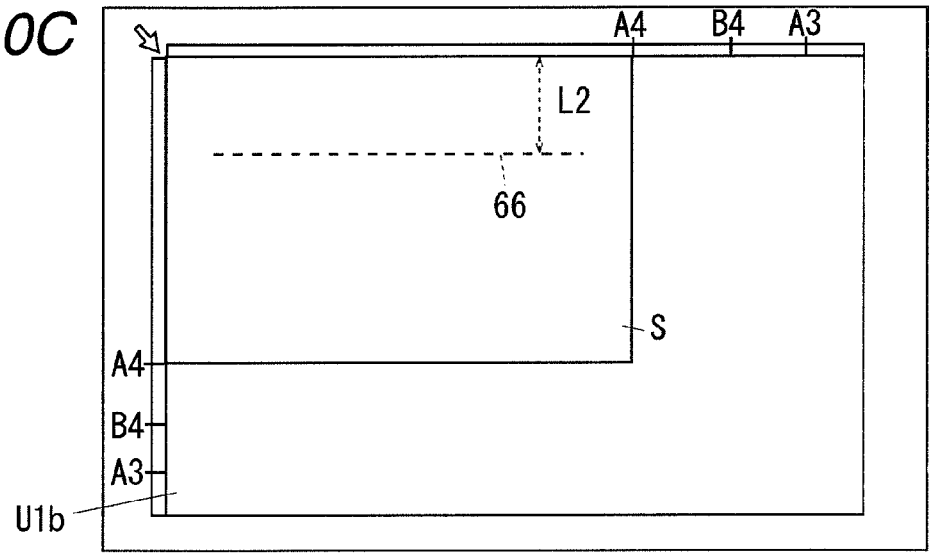
FIG. 10C is an explanatory view in which the recording sheet is laid so that the second face may be read.

FIG. 10 is an explanatory view of an image input device and the recording sheet, wherein FIG. 10A is an explanatory view before the recording sheet is laid, FIG. 10B is an explanatory view in which the recording sheet is laid so that the first face may be read, and FIG. 10C is an explanatory view in which the recording sheet is laid so that the second face may be read.

C7: Correction Image Reading Means

Correction image reading means C7 has image reading control means C7A, first image storage means C7B and second image storage means C7C, and reads the image recorded on each face of the recording sheet S with the image scanner U1*b*.

C7A: Image reading control means

Image reading control means C7A controls the image scanner U1*b* to read the image of the recording sheet S laid on the image scanner U1*b*, as shown in FIGS. 10B and 10C, if the copy start key UI1 is inputted.

C7B: First image storage means

First image storage means C7B stores the first image read by the image reading means C7A.

C7C: Second image storage means

Second image storage means C7C stores the second image read by the image reading means C7A.

C8: Image analysis means

Image analysis means C8 has image face discrimination means C8A, first face image position calculation means C8B, and second face image position calculation means C8C, and analyzes the image stored in the image storage means C7B and C7C.

C8A: Image face discrimination means

Image face discrimination means C8A discriminates whether or not the image stored in the image storage means C7B, C7C is the first face image or the second face image.

The image face discrimination means C8A of the exemplary embodiment 1 discriminates that the image is on the first face of the recording sheet S, if the first face instruction image 63 is included in the image stored in the image storage means C7B, C7C, or discriminates that the image is on the second face of the recording sheet S, if the second face instruction image 67 is included in the image stored in the image storage means C7B, C7C.

C8B: First Face Image Position Calculation Means

First face image position calculation means C8B calculates the position of the linear image 62 for the image discriminated as the first face by the image discrimination means C8A.

The first face image position calculation means C8B of the exemplary embodiment 1 calculates the distance L1 from the rear end of the recording sheet S in the medium width direction to the position of the linear image 62 and calculates the position of the linear image 62.

C8C: Second Face Image Position Calculation Means

Second face image position calculation means C8C calculates the position of the linear image 66 for the image discriminated as the second face by the image discrimination means C8A.

The second face image position calculation means C8C of the exemplary embodiment 1 calculates the distance L2 from the rear end of the recording sheet S in the medium width direction to the position of the linear image 66 and calculates the position of the linear image 66.

Figure 11A:
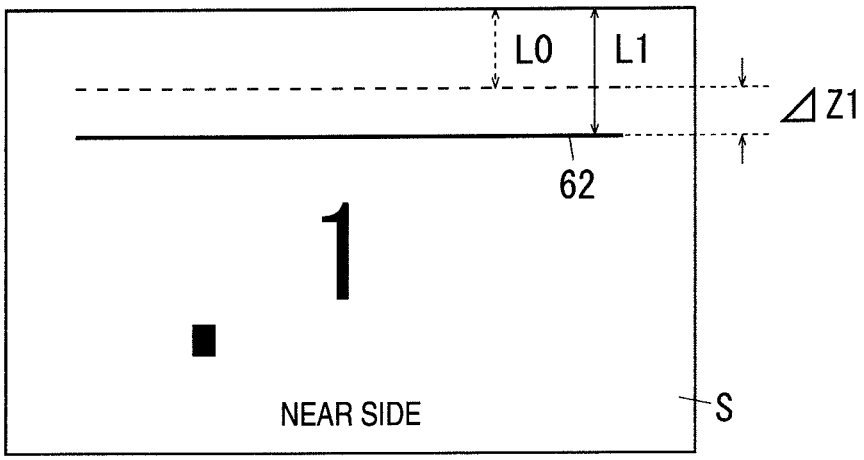
Figure 11B:
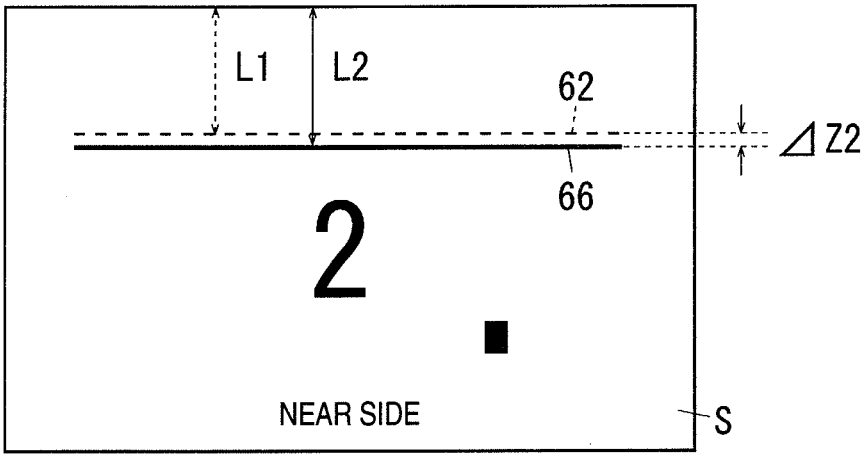

FIG. 11 is an explanatory view of the correction image recorded on the recording sheet and the misregistration amount, wherein FIG. 11A is an explanatory view of a side displacement amount and FIG. 11B is an explanatory view of a front and back displacement amount.

C9: Correction Amount Calculation Means

Correction amount calculation means C9 has side displacement amount calculation means C9A and front and back displacement amount calculation means C9B, and calculates the misregistration amount of the recording sheet S.

C9A: Side Displacement Amount Calculation Means

Side displacement amount calculation means C9A as one example of the displacement amount calculation means is set on the downstream side of the crossed roll Rc in the medium transporting direction and calculates the side displacement amount $\Delta Z1$ as one example of the misregistration amount of the recording sheet S in the medium width direction, based on the position of the image recorded on the recording sheet S and the preset reference position of the reference image, in the secondary transfer area Q4 in which the image is recorded on the recording sheet S.

In FIG. 11A, in the exemplary embodiment 1, the side displacement amount calculation means C9A calculates the side displacement amount $\Delta Z1$ ($\Delta Z1 = L1 - L0$) as the difference between the distance L1 calculated by the first face image position calculation means C8B and the preset distance L0 for the correction image 61.

C9B: Front and Back Displacement Amount Calculation Means

Front and back displacement amount calculation means C9B as one example of the second displacement amount calculation means calculates the front and back displacement amount $\Delta Z2$ as one example of the second misregistration amount that is the misregistration amount between the position of the image recorded on the first face of the recording sheet S and the position of the image recorded on the second face of the recording sheet S.

In FIG. 11B, in the exemplary embodiment 1, the front and back displacement amount calculation means C9B calculates the front and back displacement amount ΔZ2 (ΔZ2=L2−L1) by obtaining the difference between the distance L1 calculated by the first face image position calculation means C8B and the distance L2 calculated by the second face image position calculation means C8C.

C10: Plate Position Control Means

Plate position control means C10 as one example of the contacted position control means and one example of the line-up position control means controls the position of the lower-side plate 31 by moving the lower-side plate 34 in the direction of reducing the side displacement amount ΔZ1, based on the side displacement amount ΔZ1 calculated by the side displacement amount calculation means C9A. That is, the plate position control means C10 controls the position of the lower-side plate 31, controls the position of the side guide 34 by moving the side guide 34 in the direction of reducing the side displacement amount ΔZ1, based on the side displacement amount ΔZ1 calculated by the side displacement amount calculation means C9A, and controls the position of the crossed roll Rc by moving the crossed roll Rc.

The plate position control means C10 of the exemplary embodiment 1 controls the position of the lower-side plate 31 by moving the lower-side plate 31 by the side displacement amount ΔZ1 via the plate setting motor drive circuit D6, and controls the position of the side guide 34 and the position of the crossed roll Rc. In the exemplary embodiment 1, the plate position control means C10 moves forward the lower-side plate 31 by the magnitude of the side displacement amount ΔZ1, if the side displacement amount ΔZ1 is the positive value, or moves backward the lower-side plate 31 by the magnitude of the side displacement amount ΔZ1, if the side displacement amount ΔZ1 is the negative value.

C11: Tray Position Control Means

Tray position control means C11 as one example of the receiving part position control means controls the position of the sheet feed tray TR1 to TR4 by moving the sheet feed tray TR1 to TR4 in the direction of reducing the side displacement amount ΔZ1, based on the side displacement amount ΔZ1 calculated by the side displacement amount calculation means C9A.

The tray position control means C11 of the exemplary embodiment 1 controls the position of the sheet feed tray TR1 to TR4 by moving the sheet feed tray TR1 to TR4 held at the sheet feed position by the side displacement amount ΔZ1 via the tray setting motor drive circuit D5, for the sheet feed tray TR1 to TR4 from which the recording sheet S is fed. In the exemplary embodiment 1, the tray position control means C11 moves forward the sheet feed tray TR1 to TR4 by the magnitude of the side displacement amount ΔZ1, if the side displacement amount ΔZ1 is the positive value, or moves backward the sheet feed tray TR1 to TR4 by the magnitude of the side displacement amount ΔZ1, if the side displacement amount ΔZ1 is the negative value.

C12: Side Position Storage Means

Side position storage means C12 as one example of storage means for the end position of the recording sheet S in the medium width direction has first face side position storage means C12A and second face side position storage means C12B, and stores the end position of the recording sheet S in the medium width direction when the registration roll Rr transports the recording sheet S.

In the side position storage means C12 of the exemplary embodiment 1, the first face side position storage means C12A and the second face side position storage means C12B store the side position S0 as indicated in FIG. 5 that is preset according to the design of the image forming device main body U3 as the initial value.

C13: Side Position Update Means

Side position update means C13 as one example of update means for the side position updates the side position S0 stored in the side position storage means C12, based on the side displacement amount ΔZ1 and the front and back displacement amount ΔZ2.

The side position storage means C13 of the exemplary embodiment 1 updates the side position S0 stored in the first face side position storage means C12A to the side position S1 that is displaced by the side displacement amount ΔZ1 from the side position S0 in the medium width direction. Also, the side position storage means C13 of the exemplary embodiment 1 updates the side position S0 stored in the second face side position storage means C12B to the side position S2 that is displaced by the side displacement amount ΔZ1 and the front and back displacement amount ΔZ2 from the side position S0 in the medium width direction.

The side position update means C13 of the exemplary embodiment 1 updates the side position S0 to the position displaced forward by the magnitude of each displacement amount ΔZ1, ΔZ2 as the side position S1, S2, if each displacement amount ΔZ1, ΔZ2 is the positive value, or updates the side position S0 to the position displaced backward by the magnitude of each displacement amount ΔZ1, ΔZ2 as the side position S1, S2, if each displacement amount ΔZ1, ΔZ2 is the negative value.

C14: Registration Roll Control Means

Registration roll control means C14 as one example of control means for the registration roll Rr has registration roll drive control means C14A and side shift control means C14B, and controls the operation of the registration roll Rr.

C14A: Registration Roll Drive Control Means

Registration roll drive control means C14A as one example of control means for driving rotationally the registration roll Rr controls the rotational driving of the registration roll Rr via the registration roll drive circuit D2.

C14B: Side Shift Control Means

Side shift control means C14B as one example of transporting movement control means controls the movement of the registration roll Rr via the shift motor drive circuit D4 to reduce the front and back displacement amount ΔZ2 based on the front and back displacement amount ΔZ2.

The side control means C10B of the exemplary embodiment 1 side-shifts the registration roll Rr to the preset initial position before the recording sheet S is transported in recording the image on the first face of the recording sheet S, and side-shifts the registration roll Rr until the end of the recording sheet S in the medium width direction is detected at the side position S0, S1 stored in the first face side position storage means C12A by the side sensor SN2, if the recording sheet S is pinched by the registration roll Rr, that is, if the front end of the recording sheet S in the medium transporting direction is detected by the registration sensor SN1.

Also, the side control means C10B of the exemplary embodiment 1 side-shifts the registration roll Rr to the preset initial position before the recording sheet S is transported in recording the image on the second face of the recording sheet S, and side-shifts the registration roll Rr until the end of the recording sheet S in the medium width direction is detected at the side position S0, S2 stored in the second face side position storage means C12B by the side sensor SN2, if the front end of the recording sheet S in the medium transporting direction is detected by the registration sensor SN1.

C15: Crossed Roll Control Means

Crossed roll control means C15 as one example of control means for the crossed roll Rc has crossed roll drive control means C15A and crossed roll disjunction means C15B, and controls the operation of the crossed roll Rc.

C15A: Crossed Roll Drive Control Means

Crossed roll drive control means C15A as one example of control means for driving rotationally the crossed roll Rc drives rotationally the crossed roll Rc via the crossed roll drive circuit D3 while the recording sheet S is transported through the skew correction area A.

C15B: Crossed Roll Disjunction Control Means

Crossed roll disjunction control means C15B as one example of control means for disjunctive movement of the crossed roll Rc makes the slave crossed roll Rc2 contact with or separate from the drive crossed roll Rc1 via the crossed solenoid drive circuit D7.

(Explanation of Flowchart of the Exemplary Embodiment 1)

The flow of a process for the image forming device U according to the exemplary embodiment 1 of the invention will be described below using a flowchart.

(Explanation of the Flowchart of an Initial Setting Process According to the Exemplary Embodiment 1)

Figure 12:
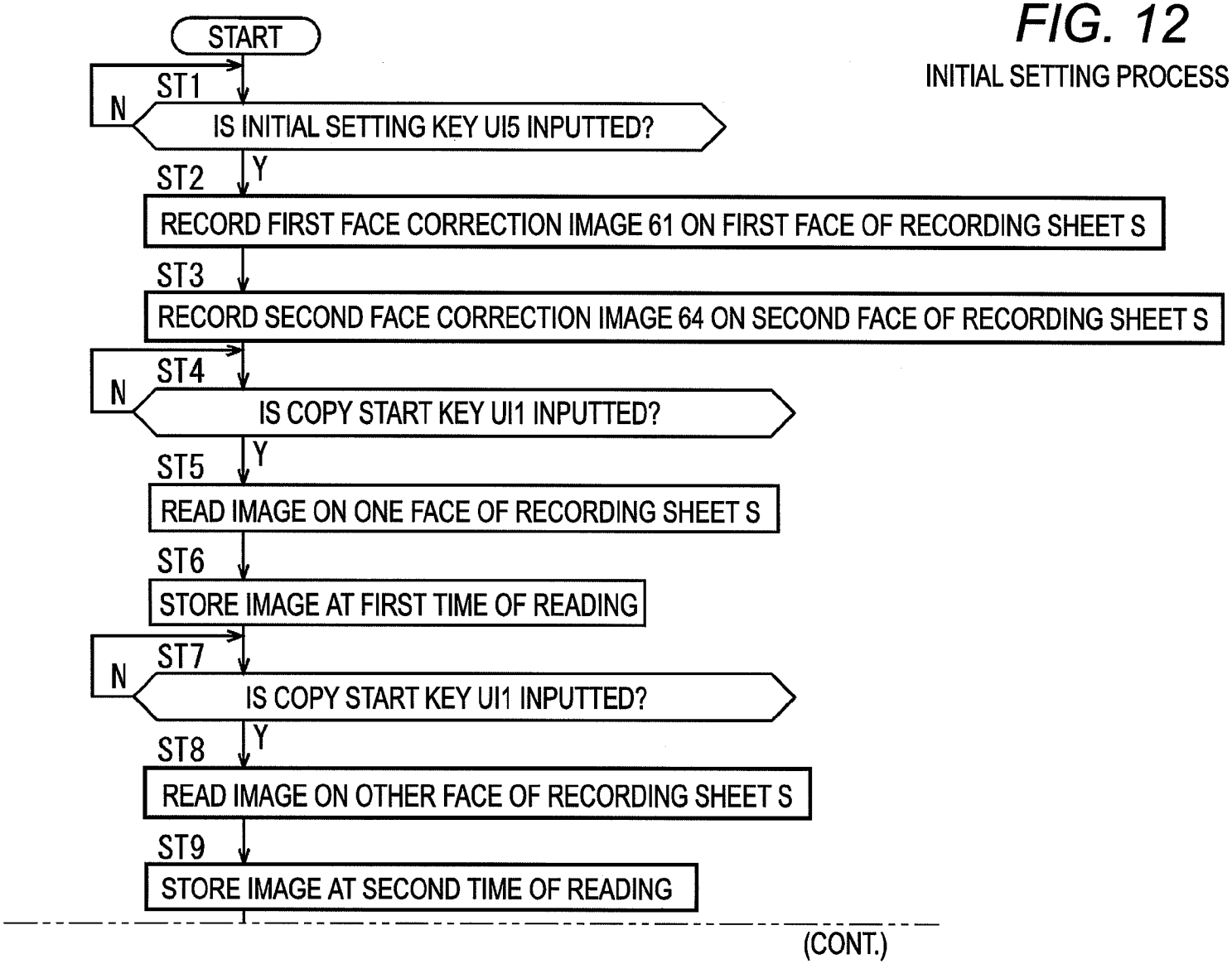
FIG. 12 is a flowchart of an initial setting process according to the exemplary embodiment 1 of the invention.

FIG. 12 is a flowchart of the initial setting process according to the exemplary embodiment 1 of the invention.

The processing of each step ST in the flowchart of FIG. 12 is performed in accordance with a program stored in the controller C of the image forming device U. Also, this process is performed as the parallel processing in parallel with various other kinds of process for the image forming device U.

The flowchart as shown in FIG. 12 is started upon turning on the power of the image forming device U.

At ST1 of FIG. 12, it is discriminated whether or not the initial setting key UI5 is inputted. In case of yes (Y), the operation goes to ST2, or in case of no (N), ST1 is repeated.

At ST2, the first face correction image 61 is recorded on the first face of the recording sheet S, and then the operation goes to ST3.

At ST3, the second face correction image 64 is recorded on the second face of the recording sheet S, and then the operation goes to ST4.

At ST4, it is discriminated whether or not the copy start key UI1 is inputted. In case of yes (Y), the operation goes to ST5, or in case of no (N), ST4 is repeated.

At ST5, the image on one face of the recording sheet S is read, and then the operation goes to ST6.

At ST6, the image on the first face, namely, at the first time of reading, is stored, and then the operation goes to ST7.

At ST7, it is discriminated whether or not the copy start key UI1 is inputted. In case of yes (Y), the operation goes to ST8, or in case of no (N), ST7 is repeated.

At ST8, the image on the other face of the recording sheet S is read, and then the operation goes to ST9.

At ST9, the image on the second face, namely, at the second time of reading, is stored, and then the operation goes to ST10.

At ST10, it is discriminated whether or not the image read at the first time and the image read at the second time are on the first face and the second face of the recording sheet S, and then the operation goes to ST11.

At ST11, the process of the following (1) and (2) is performed, and the operation goes to ST12.

(1) The position of the linear image 62 on the first face of the recording sheet S, or the distance L1 from the end in the medium width direction in the exemplary embodiment 1, is calculated.

(2) The position of the linear image 66 on the second face of the recording sheet S, or the distance L2 from the end in the medium width direction in the exemplary embodiment 1, is calculated.

At ST12, the process of the following (1) and (2) is performed, and the operation goes to ST13.

(1) The side displacement amount ΔZ1 is calculated based on the distance L1 of the first face and the preset distance L0.

(2) The front and back displacement amount ΔZ2 is calculated based on the distance L1 of the first face and the distance L2 of the second face.

At ST13, the process of the following (1) and (2) is performed, and the operation goes to ST14.

(1) The lower-side plate 31 is moved based on the side displacement amount ΔZ1 so that the position of the lower-side plate 31 is set.

(2) The sheet feed tray TR1 to TR4 is moved based on the side displacement amount ΔZ1.

At ST14, the process of the following (1) and (2) is performed, and the operation returns to ST1.

(1) The stored information of the first face side position storage means C12A is updated to the side position S1 based on the original side position S0 and the side displacement amount ΔZ1.

(2) The stored information of the second face side position storage means C12B is updated to the side position S2 based on the original side position S0, the side displacement amount ΔZ1 and the front and back displacement amount ΔZ2.

(Action of the Exemplary Embodiment 1)

In the image forming device U of the exemplary embodiment 1 having the above configuration, if a job as one example of the image forming operation is executed, the recording sheet S is fed from the preset sheet feed tray TR1 to TR4. The fed recording sheet S is transported on the sheet transporting path SH2, and sent in the skew correction area A to the side guide 34 by the crossed roll Rc to contact the side guide 34 for correcting the skew. The recording sheet S corrected for the skew is side-shifted in the medium width direction by the registration roll Rr, and transported to the secondary transfer area Q4, where the image is recorded on the first face of the recording sheet S.

In the case where the image is recorded on the second face, the recording sheet S, after the image is recorded on the first face, is transported to the sheet reversing path SH4+SH6+SH7, where the sheet is turned over, and then resent to the skew correction area A. And the image is recorded on the second face of the recording sheet in the same way as on the first face, and the recording sheet is outputted to the sheet output tray TH1.

Herein, in the image forming device U of the exemplary embodiment 1, if the initial setting input key U15 is inputted at the time of installation at the use site or for the maintenance inspection operation, the recording sheet S is fed from the preset sheet feed tray TR1 to TR4 at ST1 to ST3 of the initial setting process, in which the first face correction image 61 is recorded on the first face of the recording sheet S, and the second face correction image 64 is recorded on the second face, in the same way as the normal image forming operation on both sides of the recording sheet S, and the recording sheet is outputted to the sheet output tray TH1.

And if the exhausted recording sheet S is loaded on the image scanner U1*b*, and the copy start key UI1 is inputted, the first and second faces of the recording sheet S are read at ST4 to ST9 of the initial setting process.

And the image of each face read from the recording sheet S is analyzed at ST10 and ST11 of the initial setting process, and the position of the linear image 62 on the recording sheet S, that is, the distance L1 from the end of the recording sheet in the medium width direction to the linear image 62 as shown in FIG. 11A is calculated from the first face correction image 61 recorded on the first face. Also, the distance L2 from the end of the recording sheet S in the medium width direction to the linear image 66 as shown in FIG. 11B is calculated from the second face correction image 64 recorded on the second face of the recording sheet S, in the same way as on the first face.

If the distances L1 and L2 are calculated, the side displacement amount ΔZ1 is calculated, based on the distance L1 and the preset distance L0, namely, the distance L0 from the end of the recording sheet in the medium width direction to the linear image 62 in the correction image 61 of the original image as shown in FIG. 11A at ST2 of the initial setting process. Also, the front and back displacement amount ΔZ2 is calculated, based on the distances L1 and L2.

Figure 13A:
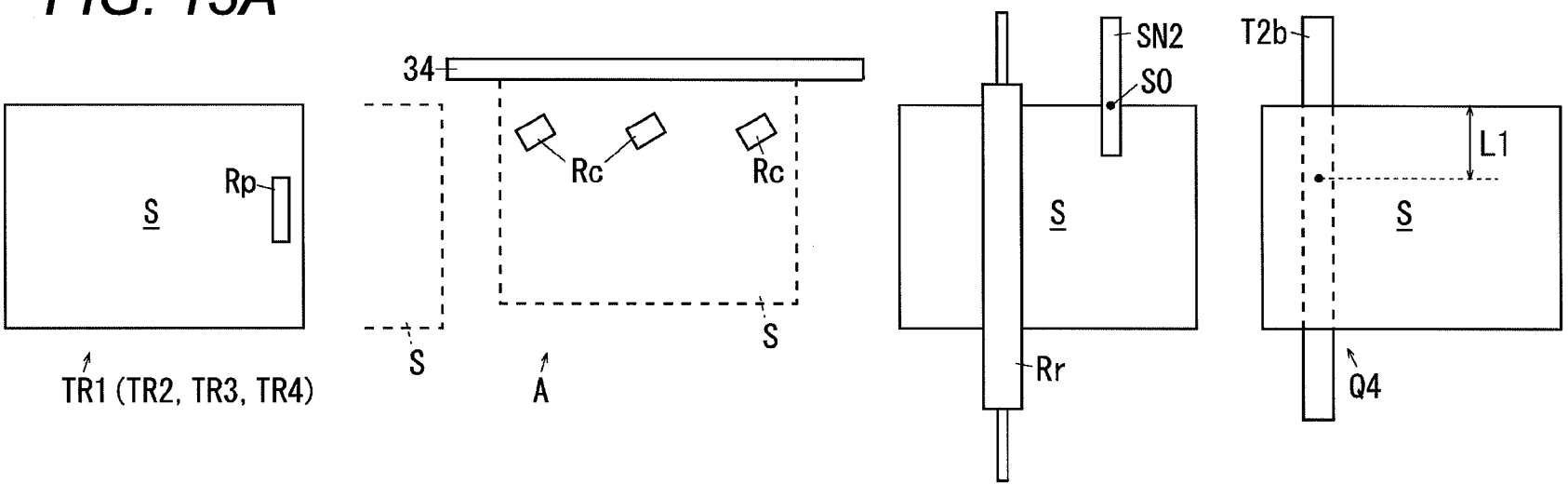
Figure 13B:
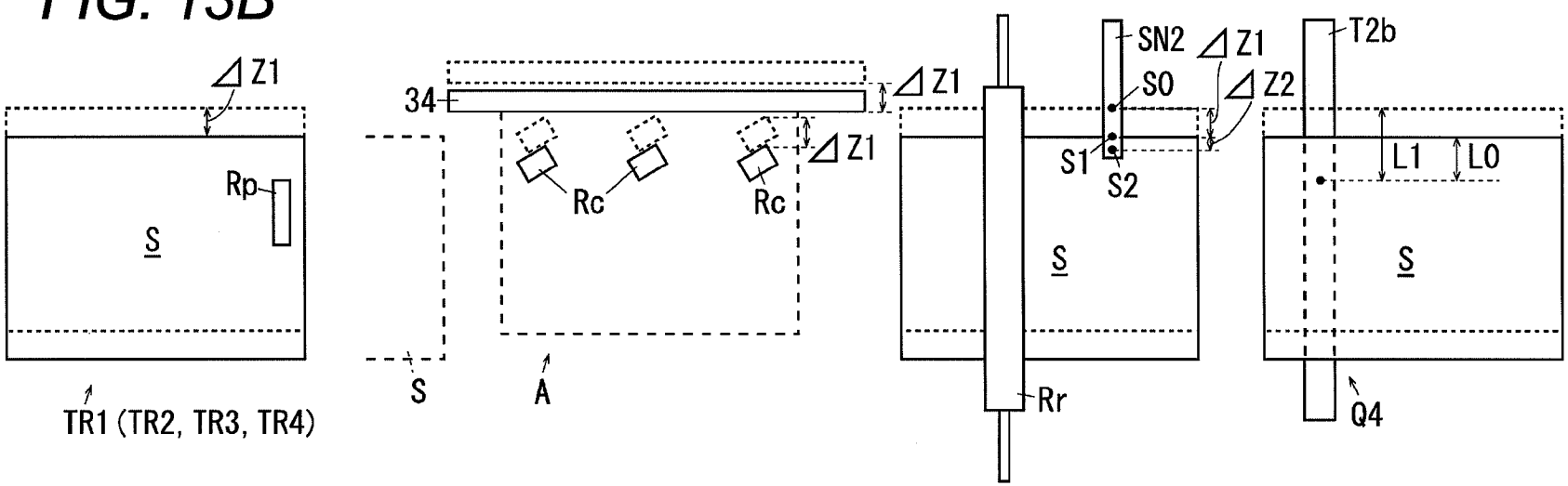

FIG. 13 is an explanatory view of the positional changes of the side guide, the crossed roll and the sheet feed trays in the medium width direction before and after the initial setting process, wherein FIG. 13A is an explanatory view of the position before the initial setting process is performed and FIG. 13B is an explanatory view of the position after the initial setting process is performed.

And if the side displacement amount ΔZ1 and the front and back displacement amount ΔZ2 are calculated, the lower-side plate 31 is moved by the side displacement amount ΔZ1 at ST13 of the initial setting process. At this time, the side guide 34 and the crossed roll Rc are also moved together with the lower-side plate 31 by the side displacement amount ΔZ1 from the position as indicated by the broken line to the position as indicated by the solid line in FIG. 13B.

Also, at ST13 of the initial setting process, the set-up sheet feed tray TR1 to TR4 is also moved by the side displacement amount ΔZ1 from the position as indicated by the broken line to the position as indicated by the solid line in FIG. 13B.

And at ST14 of the initial setting process, the position of the recording sheet S in the medium width direction in recording the image on the first face is updated to the side position S1, and the position of the recording sheet S in the medium width direction in recording the image on the second face is updated to the side position S2, whereby a series of the initial setting process is ended.

Thereby, in the image forming device U of the exemplary embodiment 1, the recording sheet S is fed and transported at the positions in the medium width direction of the side guide 34, the crossed roll Rc and the sheet feed tray TR1 to TR4 newly set through the initial setting process, whereby the image is recorded. Also, if the image is recorded on the first face, the registration roll Rr is side-shifted with reference to the side position S1, or if the image is recorded on the second face, the registration roll Rr is side-shifted with reference to the side position S2.

In the related constitution in which the recording sheet S is pinched by the transporting member alone and moved in the medium width direction until the end of the recording sheet S in the medium width direction is detected by the detection member disposed at the preset position, making the alignment of the recording sheet S in the medium width direction, it is required to increase the movement amount of the transporting member, if the recording sheet S is transported with a great misregistration in the medium width direction from the preset position.

Accordingly, if the speed of the transporting member in the medium width direction is constant, it takes a long time until the alignment is ended, whereby there is a risk that the number of recorded sheets per unit time, or what is called the productivity decreases. On the other hand, if the productivity is kept, it is required to increase the speed of the transporting member in the medium width direction, whereby there is a risk that the correction accuracy for the misregistration in the medium width direction is lower.

Also, if the misregistration of the image recorded on the recording sheet S is detected and the position of the image itself to be recorded is moved in the medium width direction as in related art, it is required that the image recording part U3*a* such as the image carriers Py to Pk, the transfer rolls T1*y* to T1*k* and the intermediate transfer belt B is made larger beforehand in the medium width direction, whereby the image recording part U3*a* is likely to have the larger size and higher cost.

On the contrary, in the image forming device U of the exemplary embodiment 1, the lower-side plate 31 is moved based on the side displacement amount ΔZ1, to change the position of the side guide 34 in the medium width direction, whereby the recording sheet S is fed by the crossed roll Rc to contact the side guide 34 to make the skew correction and the alignment in the medium width direction. And the recording sheet S after alignment is side-shifted by the registration roll Rc and transported to the secondary transfer area Q4.

That is, in the exemplary embodiment 1, the position of the recording sheet S is roughly adjusted by contact with the side guide 34, and the position of the recording sheet S is finely adjusted by the side shift of the registration roll Rr, whereby the misregistration of the recording sheet S in the medium width direction is corrected.

Accordingly, if the misregistration of the recording sheet S in the medium width direction is corrected by only the side shift of the registration roll Rr without moving the side guide 34, for example, it is required that the registration roll Rr is side-shifted by the amount of rough adjustment and fine adjustment, whereby there is a risk that the correction accuracy and the productivity decrease because the shift amount is too great. In the exemplary embodiment 1, the registration roll Rr is side-shifted by only the amount of fine adjustment, whereby the correction accuracy and the productivity are less likely to decrease. Also, it is not necessary to increase the width of the image recording part U3*a*, with the larger size and higher cost suppressed in the exemplary embodiment 1, as compared with the case of moving the position of the image itself to be recorded in the image recording part U3*a* in the medium width direction without moving the side guide 34.

Also, in the image forming device U of the exemplary embodiment 1, when the side guide 34 is moved, the crossed roll Rc is also moved together with the lower-side plate 31. That is, if the side guide 34 is moved by the side displacement amount ΔZ1, the crossed roll Rc is also moved by the side displacement amount ΔZ1. Accordingly, the gap between the crossed roll Rc and the side guide 34 in the medium width direction is kept at the preset value, unlike the constitution in which the crossed roll Rc is secured and only the side guide 34 is moved in the medium width direction.

Accordingly, in the exemplary embodiment 1, the distance that the recording sheet S is transported to the side guide 34 by the crossed roll Rc, and the position at which the crossed roll Rc contacts the recording sheet S when the recording sheet S contacts the side guide 34 are stable. That is, the skew correction performance for the recording sheet S by the crossed roll Rc and the side guide 34 is kept constant, whereby the skew correction is made stably.

Further, in the image forming device U of the exemplary embodiment 1, if the side guide 34 is moved in the medium width direction by the side displacement amount ΔZ1, the corresponding sheet feed tray TR1 to TR4 is also moved in the medium width direction by the side displacement amount ΔZ1. Accordingly, the positional relationship between the corresponding sheet feed tray TR1 to TR4 and the side guide 34 in the medium width direction is kept at the preset position, unlike the constitution in which the corresponding sheet feed tray TR1 to TR4 is secured, and only the side guide 34 is moved in the medium width direction.

Accordingly, in the exemplary embodiment 1, when the recording sheet S fed from the sheet feed tray TR1 to TR4 enters the skew correction area A, the recording sheet is likely to enter at the position the preset distance away from the side guide 34, whereby the collision with the side guide 34 is avoided, and the position of contacting the side guide 34 is likely to deviate from the preset position, stably making the skew correction, as compared with the constitution in which only the side guide 34 is moved in the medium width direction.

In the image forming device U of the exemplary embodiment 1, the registration roll Rr is side-shifted with reference to the side position S1 during the single-sided printing or in recording on the first face during the double-sided printing, and side-shifted with reference to the side position S2 in recording on the second face during the double-sided printing.

Accordingly, in the case of the double-sided printing, the recording sheet S, after contacting the side guide 34 moved by the side displacement amount ΔZ1, is side-shifted with reference to the side position S1 of the first face by the registration roll Rr and transported to the secondary transfer area Q4, where the image is recorded on the first face. And the recording sheet S, after the image is recorded on the first face, is turned over and transported, and if the same end of the recording sheet in the medium width direction contacts the side guide 34 as in recording on the first face, the recording sheet is side-shifted with reference to the side position S2 of the second face, namely, the position displaced by the front and back displacement amount ΔZ2 from the side position S1 by the registration roll Rr, and transported to the secondary transfer area Q4, where the image is recorded on the second face.

Thereby, the image is recorded at the position relatively moved by the front and back displacement amount ΔZ2 as indicated in FIG. 11B on the second face of the recording sheet S, whereby there is less misregistration in the medium width direction on the first face and the second face than the constitution in which the recording sheet is side-shifted with reference to the same side position S1 for the first face and the second face.

Accordingly, in the image forming device U of the exemplary embodiment 1, the position of the recording sheet S in the medium width direction is roughly adjusted by the side guide 34, and finely adjusted by the registration roll Rr, whereby there is less misregistration of the image on the first face and the second face in the medium width direction.

Exemplary embodiment 2

An exemplary embodiment 2 of the invention will be described below, but the components corresponding to the components of the exemplary embodiment 1 are given the same signs in the description of this exemplary embodiment 2, and the detailed description of the same components is omitted.

This exemplary embodiment 2 is different in the following points from the exemplary embodiment 1, but the same as the exemplary embodiment 1 in the other points.

(Explanation of the Controller C of the Exemplary Embodiment 2)

Figure 14:
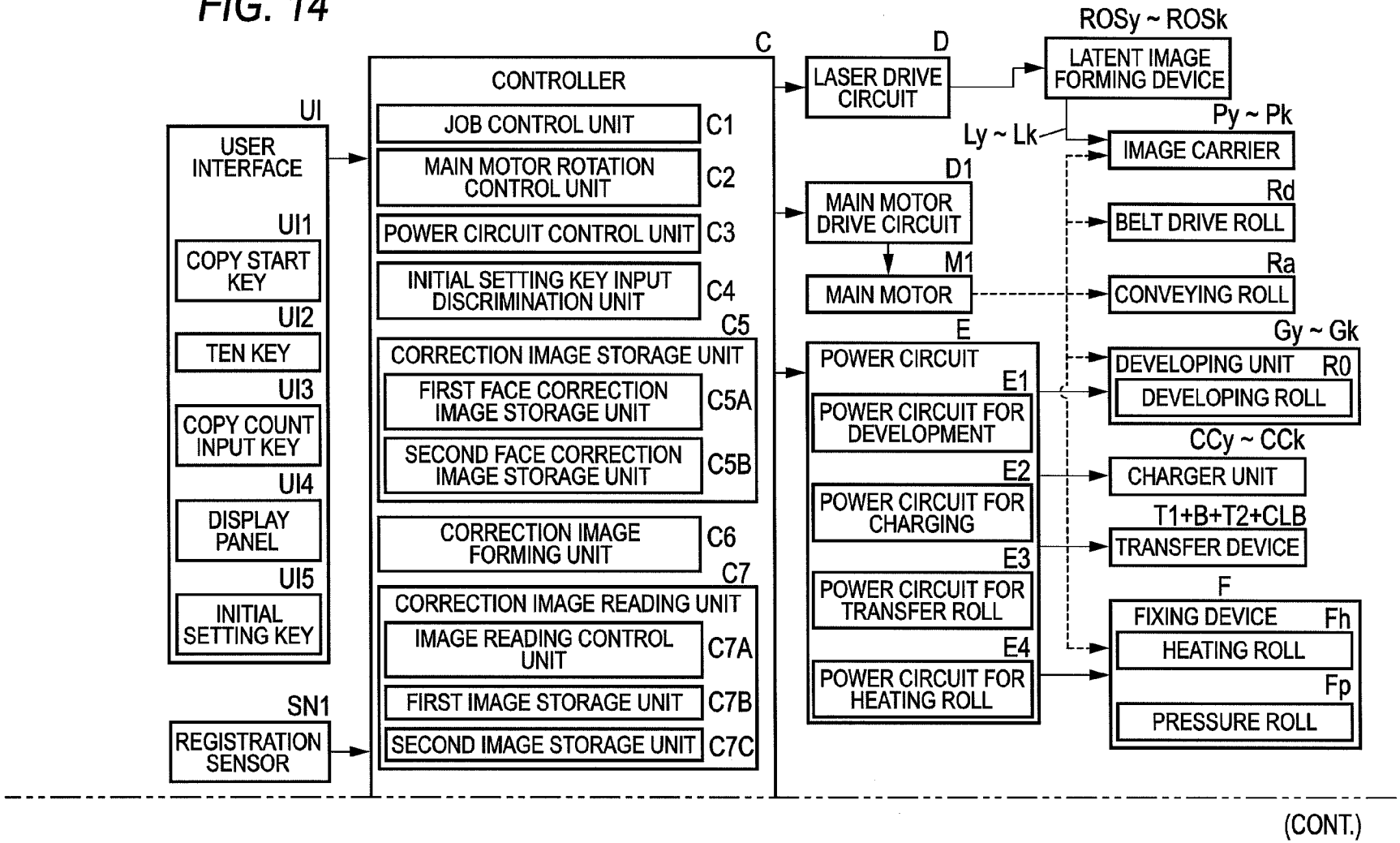
FIG. 14 is a block diagram of each function provided for a control part in an image forming device according to an exemplary embodiment 2.

FIG. 14 is a block diagram of each function provided for the control part in the image forming device according to the exemplary embodiment 2, and corresponds to FIG. 7 in the exemplary embodiment 1.

Figure 15:
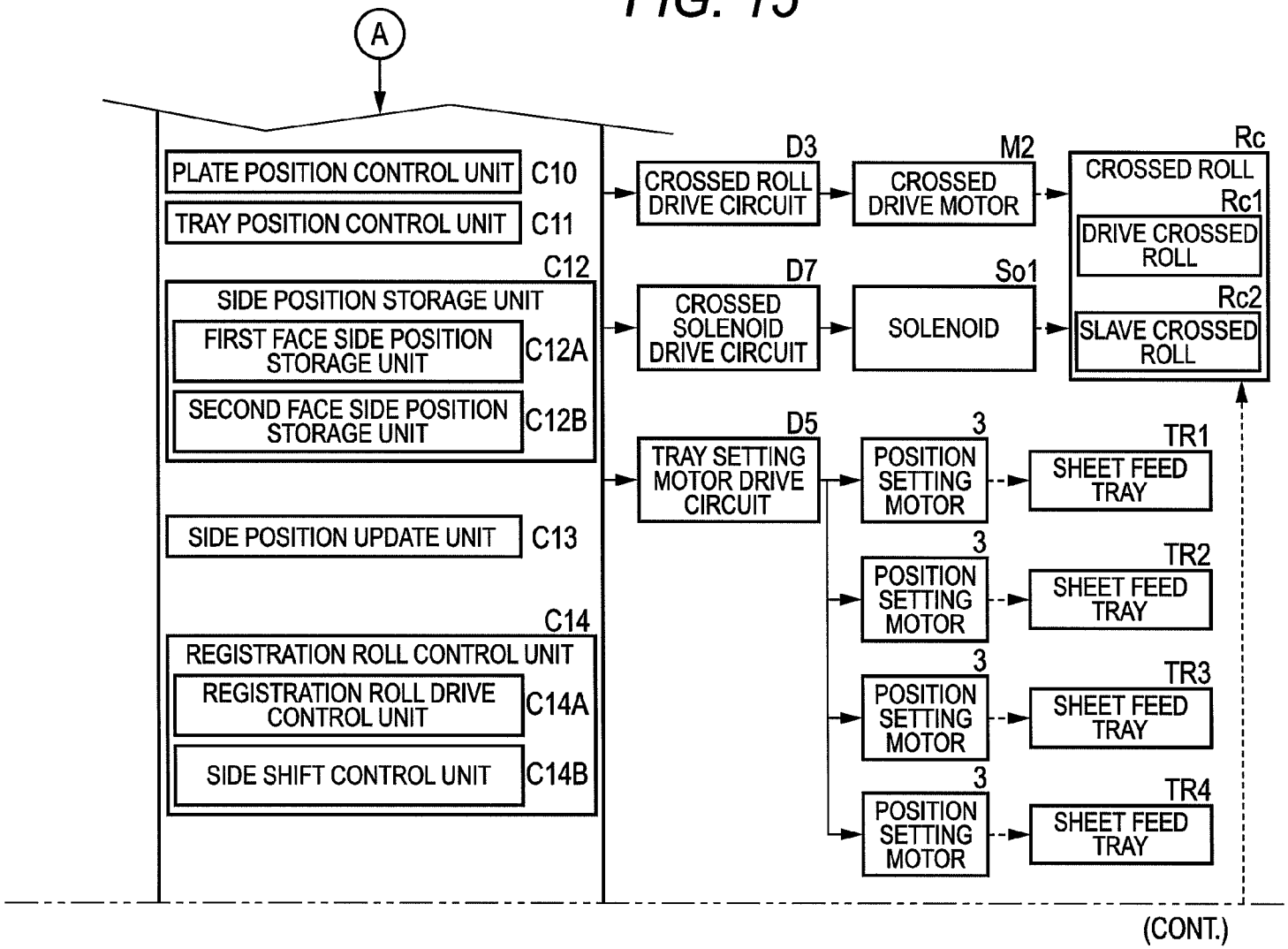
FIG. 15 is a block diagram of each function provided for the control part in the image forming device according to the exemplary embodiment 2, continued from FIG. 14.

FIG. 15 is a block diagram of each function provided for the control part in the image forming device according to the exemplary embodiment 2, continued from FIG. 14.

In FIGS. 14 and 15, the controller C of the exemplary embodiment 2 has side position update means C13' of the exemplary embodiment 2, instead of the side position update means C13 of the exemplary embodiment 1. Also, the controller C of the exemplary embodiment 2 has additionally image forming position storage means C16, image forming position update means C17 and image forming position control means C18.

C13': Side Position Update Means

The side position update means C13' of the exemplary embodiment 2 updates the side position S0 stored in each side position storage means C12A, C12B to the side position S1 displaced in the medium width direction by the side displacement amount ΔZ1 from the side position S0.

That is, while the side position update means C13 of the exemplary embodiment 1 updates the stored information of the second face side position storage means C12B based on the side displacement amount ΔZ1 and the front and back displacement amount ΔZ2, the side position update means C13' of the exemplary embodiment 2 updates the stored information of the second face side position storage means C12B based on only the side displacement amount ΔZ1, without being based on the front and back displacement amount ΔZ2.

C16: Image Forming Position Storage Means

The image forming position storage means C16 as one example of the storage means for the position of forming the latent image on the image carrier Py to Pk has first face image forming position storage means C16A and second face forming position storage means C16B, and stores the position of the latent image formed on the image carrier Py to Pk.

In the image forming position storage means C16 of the exemplary embodiment 2, the first face image forming position storage means C16A and the second face forming position storage means C16B store the image forming position in the main scan direction preset according to the design of the image forming device main body U3 as the initial value.

C17: Image Forming Position Update Means

The image forming position update means C17 as one example of the update means for the image forming position updates the image forming position stored in the image forming position storage means C16, based on the front and back displacement amount ΔZ2 and the image forming position stored in the image forming position storage means C16.

The image forming position update means C17 of the exemplary embodiment 2 updates the image forming position stored in the second face image forming position storage means C16B of the image forming position storage means C16 to the position displaced in the main scan direction by the front and back displacement amount ΔZ2. The image forming position update means C17 of the exemplary embodiment 2 updates the image forming position to the position displaced backward in the main scan direction by the front and back displacement amount ΔZ2 from the preset position as the image forming position, if the front and back displacement amount ΔZ2 is the positive value, or updates the image forming position to the position displaced forward in the main scan direction by the front and back displacement amount ΔZ2 from the preset position as the image forming position, if the front and back displacement amount ΔZ2 is the negative value.

C18: Image Forming Control Means

The image forming control means C18 as one example of the recording part control means controls the image recording part U3*a* to record the image to be recorded on the second face by moving it in the medium width direction to reduce the front and back displacement amount ΔZ2 based on the front and back displacement amount ΔZ2.

The image forming control means C18 of the exemplary embodiment 2 records the image on the second face by forming the latent image displaced by the front and back displacement amount ΔZ2 in the medium width direction, or what is called the main scan direction, and moving the image to be recorded on the second face in the medium width direction, in recording the image on the second face when forming the latent image on the image carrier Py to Pk via the laser drive circuit D.

That is, the image forming control means C16 of the exemplary embodiment 2 records the image on the first face of the recording sheet S by forming the latent image on the image carrier Py to Pk based on the image forming position stored in the first face image forming position storage means C16A in recording the image on the first face of the recording sheet S. Also, the image forming control means C18 of the exemplary embodiment 2 records the image on the second face of the recording sheet S by forming the latent image displaced by the front and back displacement amount ΔZ2 on the image carrier Py to Pk based on the image forming position stored in the second face image forming position storage means C16B in recording the image on the second face of the recording sheet S.

(Explanation of Flowchart of the Exemplary Embodiment 2)

The flow of a process for the image forming device U according to the exemplary embodiment 1 of the invention will be described below using a flowchart.

(Explanation of the Flowchart of an Initial Setting Process According to the Exemplary Embodiment 2)

Figure 16:
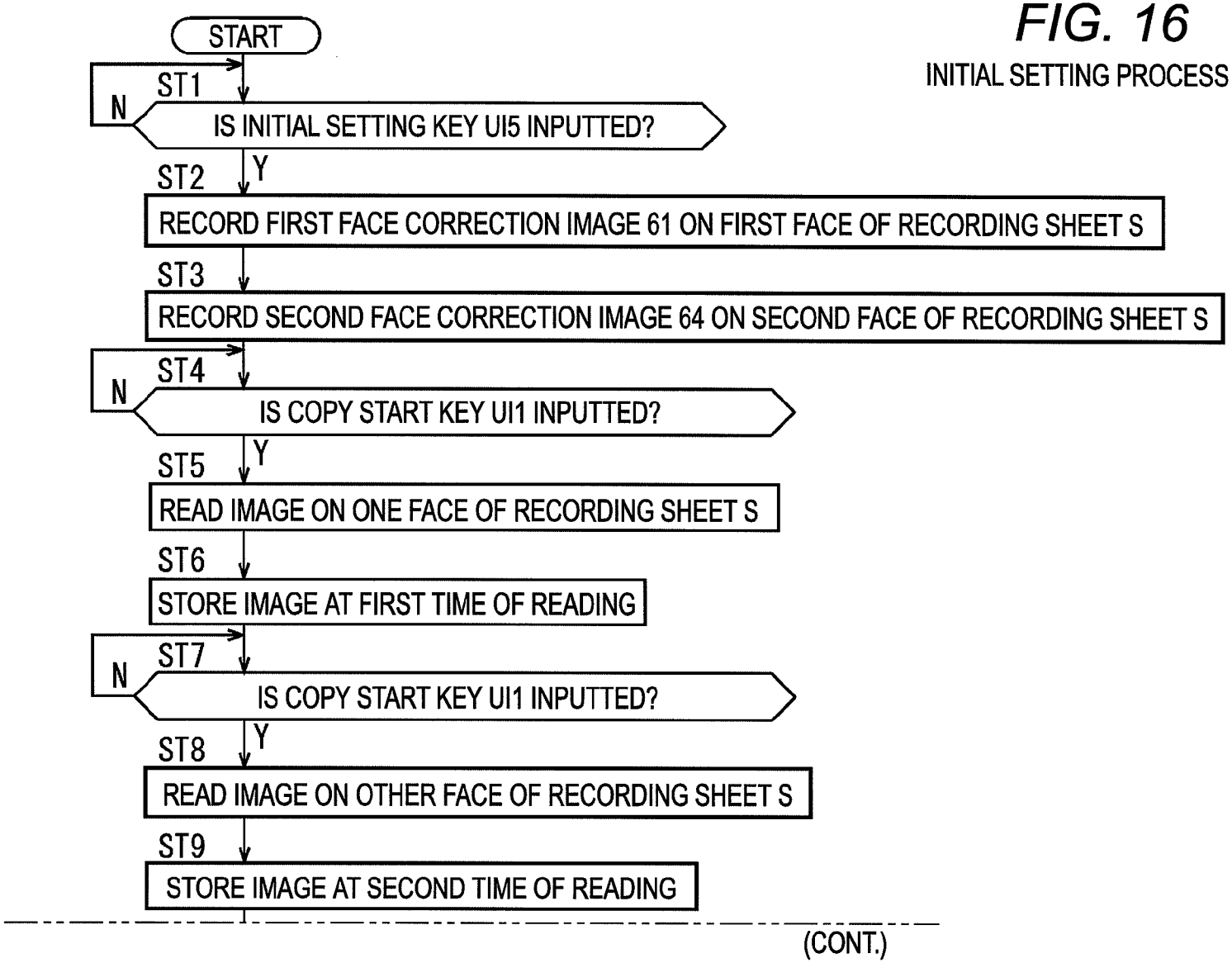
FIG. 16 is a flowchart of an initial setting process according to the exemplary embodiment 2, corresponding to FIG. 12 of the exemplary embodiment 1.

FIG. 16 is a flowchart of the initial setting process according to the exemplary embodiment 2, corresponding to FIG. 12 of the exemplary embodiment 1.

In FIG. 16, in the flowchart of the exemplary embodiment 2, ST14' and ST15 are performed, instead of ST14 in the exemplary embodiment 1.

At ST14', the process of the following (1) and (2) is performed, and the operation goes to ST15.

(1) The stored information of the first face side position storage means C12A is updated to the side position S1, based on the original side position S0 and the side displacement amount ΔZ1.

(2) The stored information of the second face side position storage means C12B is updated to the side position S1, based on the original side position S0 and the side displacement amount ΔZ1.

At ST15, the stored information of the second face image forming position storage means C16B is updated based on the front and back displacement amount ΔZ2, and the operation returns to ST1.

(Action of the Exemplary Embodiment 2)

In the image forming device U of the exemplary embodiment 2 having the above configuration, like the exemplary embodiment 1, the side guide 34 is moved based on the side displacement amount ΔZ1 and contacted by the recording sheet S to correct for the skew, and the position in the medium width direction is roughly adjusted and finely adjusted by side-shifting the registration roll Rr, whereby the misregistration of the recording sheet S in the medium width direction is reduced.

Also, in the case of the double-sided printing, the image recording part U3*a* records the image on the second face of the recording sheet S at the position displaced by the front and back displacement amount ΔZ2 in the medium width direction from the position recorded on the first face, reducing the misregistration of the image due to the front and back displacement amount ΔZ2, though in the exemplary embodiment 1, the shift amount of the registration roll Rr is changed between the first face and the second face by side-shifting the registration roll Rr with reference to the side position S1 in recording on the first face and the side position S2 in recording on the second face.

That is, in the exemplary embodiment 2, the position of the side guide 34 in the medium width direction is changed to correct for the side displacement amount ΔZ1, and the recording position of the image by the image recording part U3*a* is changed to correct for the front and back displacement amount ΔZ2. Accordingly, in the exemplary embodiment 2, the correction accuracy and the productivity are less likely to decrease, with the larger size and higher cost of the image recording part U3*a* suppressed, reducing the misregistration of the recording sheet S in the medium width direction, as compared with the constitution of changing the recording position of the image by the image recording part U3*a* based on both the side displacement amount ΔZ1 and the front and back displacement amount ΔZ2, reducing the misregistration.

Modifications

Though the exemplary embodiments of the invention have been described above in detail, the invention is not limited to the above exemplary embodiments, and various modifications may be made without departing from the spirit or scope of the invention. The modifications (H01) to (H013) of the invention are exemplified below.

(H01) Though the copying machine U as one example of the image forming device has been exemplified in each of the above exemplary embodiments, the invention is not limited to this, but may be applicable to a printer, a FAX, or a multifunction device having these multiple functions. Also, the invention is not limited to the electro-photographic image forming device, but may be applicable to the other image forming device of any image forming method such as an ink jet recording method, a thermal head method or lithography. Also, the invention is not limited to the image forming device of multicolor development, but may be applicable to a single color, or so-called monochrome image forming device.

(H02) In each of the above exemplary embodiments, it is desirable that the registration roll Rr is side-shifted until the end of the recording sheet S in the medium width direction is detected at the side position S1, S2 stored in the side position storage means C12 by the side sensor SN2, but the invention is not limited to this. For example, the side sensor SN2 may be omitted, and the registration roll Rr may be moved by the preset shift amount for the first face in recording on the first face, and moved by a total of the shift amount for the first face and the front and back displacement amount ΔZ2 in recording on the second face.

(H03) In each of the above exemplary embodiments, it is desirable that the side sensor SN2 is a so-called line sensor, but plural of sensors may be disposed.

(H04) In each of the above exemplary embodiments, it is desirable that the registration roll Rr is side-shifted, but the invention may be applicable to the constitution in which the registration roll Rr is not side-shifted. For example, the invention is applicable to what is called the single-sided printing image forming device. In the case where the invention is applied to the single-sided printing image forming device, a series of steps for calculating and setting the front and back displacement amount ΔZ2 can be omitted.

(H05) In each of the above exemplary embodiments, the front and back displacement amount ΔZ2 is calculated and set, and the registration roll Rr is side-shifted based on the front and back displacement amount ΔZ2, and the image recording part U3*a* records the image, although a series of steps for calculating and setting the front and back displacement amount ΔZ2 may be omitted depending on the precision of parts or the precision required according to the specifications of the image forming device.

(H06) In each of the above exemplary embodiments, the crossed roll Rc and the side guide 34 are supported on the lower-side plate 31, and integrally moved together with the lower-side plate 31 by the driving of the position setting motor 33, although the crossed roll Rc and the side guide 34 may be moved in the medium width direction independently of each other by the different movement mechanisms.

(H07) In each of the above exemplary embodiments, it is desirable that the crossed roll Rc is moved in the medium width direction by the side displacement amount ΔZ1 for which the side guide 34 is moved, but the invention is not limited to this. For example, the crossed roll Rc may be moved in the medium width direction by a smaller amount than the side displacement amount ΔZ1, or secured and not moved in the medium width direction.

(H08) In each of the above exemplary embodiments, the sheet feed tray TR1 to TR4 is moved in the medium width direction by the side displacement amount ΔZ1 for which the side guide 34 is moved, but the invention is not limited to this. For example, the crossed roll Rc may be moved in the medium width direction by a smaller amount than the side displacement amount ΔZ1, or secured and not moved in the medium width direction.

(H09) In each of the above exemplary embodiments, the recording sheet S is stored in the sheet feed tray TR1 to TR4 in a state where it is sandwiched between the rear side guide 20 and the front side guide 21, and the overall sheet feed tray TR1 to TR4 is moved in the medium width direction to feed the recording sheet S, but the invention is not limited to this. For example, the rear side guide 20 and the front side guide 21 may be constructed to be movable in the medium width direction in a state where the recording sheet S is sandwiched between both the side guides 20 and 21, and the rear side guide 20 and the front side guide 21 may be moved inside the sheet feed tray TR1 to TR4 without changing the position of the sheet feed tray TR1 to TR4, to feed the recording sheet S by changing the position of the recording sheet S.

(H010) In each of the above exemplary embodiments, the position of the side guide 34, the crossed roll Rc or the sheet feed tray TR1 to TR4 in the medium width direction is set by the position setting motor 3, 33 and fixed, but it may be fixed by a screw or the like as one example of a fixing member after the position is set by the position setting motor 3, 33.

(H011) In each of the above exemplary embodiments, the correction image 61, 64 of the recording sheet S is read by the image scanner U1*b* as one example of the image reading part, and the side displacement amount ΔZ1 and the front and back displacement amount ΔZ2 are calculated, but the invention is not limited to this. For example, a detection member for reading the correction image 61, 64 may be provided on the transporting path SH, and the side displacement amount ΔZ1 and the front and back displacement amount ΔZ2 may be calculated.

(H012) In each of the above exemplary embodiments, it is desirable that the side guide 34 is moved in the medium width direction by the side displacement amount ΔZ1, but the invention is not limited to this. For example, the side guide 34 may be side-shifted by part of the side displacement amount ΔZ1 and the registration roll Rr may be side-shifted including the remaining part of the side displacement amount ΔZ1, or the image recording part U3*a* may change the position of the image including the remaining part of the side displacement amount ΔZ1 and record the image.

(H013) In each of the above exemplary embodiments, the registration roll Rr is side-shifted by the front and back displacement amount ΔZ2 in recording on the second face during the double-sided printing, and the image recording part U3*a* changes the position of the image by the front and back displacement amount ΔZ2 and records the image, but the invention is not limited to this. For example, in recording on the second face during the double-sided printing, the registration roll Rc may be side-shifted by part of the front and back displacement amount ΔZ2, and the image recording part U3*a* may change the position of the image by the remaining part of the front and back displacement amount ΔZ2 and record the image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A medium transporting device comprising:

a transporting path on which a medium is transported;

a contacted member that is provided on the transporting path to be movable in a medium width direction orthogonal to a medium transporting direction, and is contacted by an end of the medium transported on the transporting path in the medium width direction;

a line-up member on the transporting path that lines up a position of the medium by sending the medium transported on the transporting path to the contacted member to bring the end of the medium in the medium width direction into contact with the contacted member;

a displacement amount calculation unit that calculates a misregistration amount of the medium in the medium width direction based on a position of an image recorded on the medium and a reference position of a reference image in an image recording area where the image is recorded on the medium;

a contacted position control unit that controls a position of the contacted member by moving the contacted member in a direction of reducing the misregistration amount based on the misregistration amount calculated by the displacement amount calculation unit; and wherein the contacted position control unit is configured to move the contacted member by a magnitude of the misregistration amount and is configured to control the line-up member to line up a position of the medium to contact the contacted member based on the magnitude of the misregistration amount to correct the misregistration amount.

2. The medium transporting device according to claim 1 further comprising:

an image reading part that reads the image recorded on the medium, wherein the displacement amount calculation unit calculates the misregistration amount of the medium in the medium width direction based on the position of the image on the medium read by the image reading part and the reference position of the reference image.

3. The medium transporting device according to claim 1 further comprising:

a line-up position control unit, wherein the line-up member is movable in the medium width direction, and the line-up position control unit controls a position of the line-up member by moving the line-up member in a direction of reducing the misregistration amount based on the misregistration amount calculated by the displacement amount calculation unit.

4. The medium transporting device according to claim 1 further comprising:

a medium receiving part that is movable in the medium width direction and receives the medium supplied to the transporting path, and a receiving part position control unit that controls a position of the medium receiving part by moving the medium receiving part in a direction of reducing the misregistration amount based on the misregistration amount calculated by the displacement amount calculation unit.

5. The medium transporting device according to claim 1 further comprising:

a reversing path connected on a downstream side of the image recording area and connected on an upstream side of the line-up member, in which the medium with the image recorded on the first face in the image recording area is turned over and transported to the upstream side of the line-up member, a first transporting member between the line-up member and the image recording area that transports the medium transported on the transporting path to the image recording area, the first transporting member being movable in the medium width direction, and a transporting movement control unit that controls a movement of the first transporting member to reduce a second misregistration amount based on the second misregistration amount that is the misregistration amount between the position of the image recorded on the first face of the medium and the position of the image recorded on the second face of the medium.

6. An image forming device comprising:

a medium transporting device according to claim 1; and an image recording part that records the image on the medium in the image recording area set in the medium transporting device.

7. The image forming device according to claim 6 further comprising:

a reversing path connected on a downstream side of the image recording area and connected on an upstream side of the line-up member, in which the medium with the image recorded on a first face in the image recording area is turned over and transported to the upstream side of the line-up member, and a recording part control unit that controls the image recording part to record by moving positioning of the image to be recorded on a second face in the medium width direction to reduce a second misregistration amount based on the second misregistration amount that is the misregistration amount between the position of the image recorded on the first face of the medium and the position of the image recorded on the second face of the medium.

8. The medium transporting device according to claim 1 further comprising:

a medium receiving part for storing the medium that is movable in the medium width direction and receives the medium supplied to the transporting path.

* * * * *